US006883342B2

(12) United States Patent
Kato et al.

(10) Patent No.: US 6,883,342 B2
(45) Date of Patent: Apr. 26, 2005

(54) MULTIFORM GAS HEAT PUMP TYPE AIR CONDITIONING SYSTEM

(75) Inventors: Tadahiro Kato, Toyoake (JP); Tsukasa Kasagi, Ama-gun (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 169 days.

(21) Appl. No.: 10/175,801

(22) Filed: Jun. 21, 2002

(65) Prior Publication Data

US 2002/0194857 A1 Dec. 26, 2002

(30) Foreign Application Priority Data

Jun. 26, 2001 (JP) ..... 2001-193187
Jun. 26, 2001 (JP) ..... 2001-193188
Jun. 26, 2001 (JP) ..... 2001-193189
Jun. 26, 2001 (JP) ..... 2001-193190

(51) Int. Cl.[7] ..... F25B 27/00; F25B 13/00
(52) U.S. Cl. ..... 62/238.7; 62/324.6
(58) Field of Search ..... 62/159, 193, 238.7, 62/324.1, 324.4, 324.6

(56) References Cited

U.S. PATENT DOCUMENTS 4,878,357 A 11/1989 Sekigami et al.
5,303,770 A 4/1994 Dierbeck
5,651,258 A 7/1997 Harris
5,729,985 A 3/1998 Yoshihara et al.

FOREIGN PATENT DOCUMENTS

JP 1-247967 10/1989
JP 7-43042 2/1995
JP 7151413 6/1995
JP 9-60994 3/1997

*Primary Examiner*—Denise L. Esquivel
*Assistant Examiner*—Malik N. Drake
(74) *Attorney, Agent, or Firm*—Oblon, Spivak, McClelland, Maier & Neustadt, P.C.

(57) ABSTRACT

There is provided a multiform gas heat pump type of air conditioning system having: a plurality of indoor units that are each provided with an indoor heat exchanger and that perform a heat exchange between air inside a room and refrigerant; an outdoor unit provided with a compressor driven by a gas engine and an outdoor heat exchanger for performing a heat exchange between outside air and the refrigerant; and a split flow control unit for controlling a flow direction of the refrigerant in each of the indoor units and for performing a selection switching between cooling and heating operations. The outdoor heat exchanger that switches selection between cooling and heating operations is divided into a plurality of units that are connected in parallel and there is also provided a refrigerant supply switching means that controls the refrigerant flow in each of the divided portions of the outdoor heat exchanger.

6 Claims, 16 Drawing Sheets

MULTIFORM GAS HEAT PUMP TYPE AIR CONDITIONING SYSTEM

BACKGROUND OF THE INVENTION

1. Field of the Invention

The present invention relates to a gas heat pump type of air conditioning system that drives a refrigerant compressor using a gas engine and when performing a heating operation uses exhaust gas from the gas engine as the heating source for a liquid coolant, and particularly to a multiform gas heat pump type of air conditioning system that is provided with a plurality of indoor units and allows a selection to be made between all units performing a cooling operation, all units performing a heating operation, and a combination of simultaneous heating and cooling operations and allows the subsequent switching of the units to the selected option.

2. Description of the Related Art

An air conditioning system that performs air conditioning operations such as heating and cooling using a heat pump is provided with a refrigerant circuit that includes elements such as an indoor heat exchanger, a compressor, an outdoor heat exchanger, and a diaphragm mechanism and the like. Indoor heating and cooling are achieved by the indoor heat exchanger and the outdoor heat exchanger performing heat exchange between air inside a building (referred to below as "indoor air") and outdoor air as refrigerant circulates around this circuit. In some cases, a refrigerant heater that directly heats the refrigerant itself is added to the refrigerant circuit in order that the system does not have to rely solely on the receiving of heat from the refrigerant by the outdoor heat exchanger (when performing a heating operation).

In recent years, power sources for the compressor provided on the above described refrigerant circuit have been developed that use a gas engine instead of an electric motor. Air conditioning systems that use this gas engine are commonly known as gas heat pump type air conditioning systems (abbreviated below to GHP systems). In these GHP systems, because town gas, which is comparatively inexpensive, can be used as fuel, running costs are reduced in comparison with air conditioning systems having compressors that use electric motors (abbreviated below to EHP systems). Accordingly, the advantage to a user is that lower costs become possible.

Moreover, in a the GHP system, when the system is performing the heating operation, for example, if high temperature exhaust gas discharged from the gas engine and the heat from cooling water used to cool the engine (known as waste or exhaust heat) are used as heating sources for the refrigerant, then an excellent heating effect can be obtained and the energy utilization efficiency increased in comparison with the EHP system. In such cases, the energy utilization efficiency of the GHP system is approximately 1.2 to 1.5 times greater than that of the EHP system. By introducing this type of mechanism, the need to install a special apparatus such as the above described refrigerant heater or the like on the refrigerant circuit is done away with.

In addition, when an operation to remove frost and the like (known as a defrosting operation), which is necessary when the system is performing the heating operation, are performed for the outdoor heat exchanger. In the GHP system, this can be carried out using waste heat from the gas engine. Commonly, when performing the defrosting operation in the EHP system, the heating operation is stopped and the cooling operation is temporarily performed so as to remove frost from the outdoor heat exchanger. As a result, cold air is blown into the room causing a lowering of the comfort level of the indoor environment. In contrast, in the GHP system, because continuous operation is possible for the reasons described above, the problem as described above that has caused in the EHP system does not materialize.

On the other hand, in the EHP system, systems known as multiform systems have been developed. In these multiform systems, it is possible to prepare a plurality of indoor units, place each indoor unit in one of a plurality of various spaces that are to be air conditioned, and cool all of the spaces (i.e., corresponding to the total number of indoor units) or a part of the spaces, or heat all of the spaces (i.e., corresponding to the total number of indoor units) or a part of the spaces. In addition, it is possible to simultaneously perform either the cooling operation, the heating operation, or suspend operations in each space to be air conditioned or for each indoor unit. This type of EHP systems are disclosed in, for example, Japanese Unexamined Patent Application, First Publication Nos. L-247967, 7-43042, and 9-60994.

Accordingly, the application of the same type of multiform system that is used in the EHP system is desired for indoor units of the GHP system that has the numerous advantages as described above.

When the multiform system is applied to the GHP system, it is necessary to match the condensing performance and evaporation performance of outdoor heat exchangers provided in outdoor units with the wide range of requirements that correspond to the operating state of each indoor unit. For example, when the main operation being performed is cooling operation, the condensation performance sought from the outdoor heat exchanger functioning as a condenser changes greatly in accordance with the combination of the number of indoor units currently operating as coolers and the number of indoor units currently operating as heaters. Therefore, a low cost system that can easily demonstrate a condensing performance and evaporation performance that match such requirements is desired.

FIG. 16 is a Mollier diagram showing a refrigeration cycle of an air conditioning system. When the system is performing the cooling operation, the area between i1 and i2 in the diagram is the cooling performance (i.e., evaporation) of an indoor heat exchanger. In order to obtain this cooling performance, it is necessary to obtain the condensing performance between i3 to i1 from the outdoor heat exchanger. However, when a mixture of cooling and heating operations are being performed respectively by a plurality of indoor units, because the heating (i.e., condensing) performance between i4 and i1 is obtained from the small number of indoor heat exchangers that are performing the cooling operation, it is sufficient if a condensing performance corresponding to the area between i3 and i4 is provided by the outdoor heat exchanger. Namely, the cooling performance between i1 and i2 and the heating performance between i4 and i1 are values that change in accordance with the operating state selected by the user. Therefore, the condensing performance required from the outdoor heat exchanger also changes greatly in accordance with this operating state.

When the system is mainly performing the heating operation, the evaporation performance obtained from the small number of indoor heat exchangers that are performing the cooling operation and the condensing performance obtained from the majority of heat exchangers performing the heating operation also change in accordance with the operating state selected by the user. Therefore, the evaporation performance required from the outdoor heat exchanger functioning as an evaporator also changes greatly in accordance with this operating state. Note that, during the heating operation, for example, if engine cooling water is supplied from the gas engine to a water heat exchanger and waste heat from the gas engine is used, then it is possible to supplement the evaporation performance of the outdoor heat exchanger functioning as the evaporator.

Furthermore, when the multiform system is used in the GHP system, if the system is performing the heating operation when outside temperatures are low, moisture in the air sometimes forms as frost on the surface of the outdoor heat exchanger functioning as the evaporator. As a result, the heat exchanging ability of the outdoor heat exchanger decreases and the refrigerant cannot be sufficiently evaporated, and the heating performance of the system deteriorates. To counter this type of frost formation in the outdoor heat exchanger, in a conventional system, a continuous heating operation is made possible by performing a defrosting operation using waste heat from the engine. However, this cannot prevent variations in the heating abilities caused by the frost formation. Therefore, in the multiform gas heat pump type of air conditioning system, the heat exchanger is desired that enables the refrigerant to be evaporated efficiently over a wide range of temperatures with no frost formation when performing the heating operation when outside temperatures are low.

Moreover, when the multiform system is used in the GHP system, in order to ensure stable operating efficiency from the compressor, it is necessary to provide a suitable degree of superheat (approximately 5° C. to 10° C.) to the gas refrigerant that is taken in. However, because it is difficult for sufficient heat to be obtained from the outside air by the outdoor heat exchanger functioning as the evaporator when the outside temperature is low, the necessary degree of superheat cannot be provided to the refrigerant. As a result, the refrigerant is supplied to the compressor still in the form of a two-phase gas and liquid, and the performance of the system deteriorates. In addition, when the system performs the heating operation in low outside temperatures like this, not only is it not possible to obtain a sufficient heating performance, but also the coefficient of performance (COP) is reduced, and measures to counter this are desired.

Furthermore, when the multiform system is used in a GHP system, when the outdoor heat exchanger is separated into a plurality of units that are connected together in parallel, and a refrigerant supply switching means is provided to control the flow of refrigerant to each separate outdoor heat exchanger portion, there are cases when the operation of the separate outdoor heat exchangers is suspended due to the operating state of the indoor units. In the outdoor heat exchanger whose operation is suspended, the liquefied refrigerant due to the relationship between the outside temperature and the refrigerant saturation temperature may accumulates in the outdoor heat exchanger. If this phenomenon occurs, there is an insufficient amount of refrigerant circulating in the refrigeration cycle and, as a result, there is a possibility of the problem arising that the necessary cooling and heating performances cannot be obtained. Therefore, in the multiform gas heat pump type of air conditioning system in which the outdoor heat exchangers are separated into a plurality of units, it is necessary to recover the liquefied refrigerant accumulated in the outdoor heat exchangers whose operations have been suspended.

The present invention was conceived in view of each of the above circumstances and it is a first object thereof to provide a multiform gas heat pump type of air conditioning system that is provided with a plurality of indoor units and that is provided with an inexpensive system capable of easily changing performance in response to required variations in condensing performance and vaporization performance in an outdoor heat exchanger in accordance with the operating state of a multiform system that is capable of performing both cooling and heating operations.

It is a second object of the present invention to provide a multiform gas heat pump type of air conditioning system capable of evaporating the refrigerant with no frost formation and giving excellent heating performance even when performing the heating operation when the outside temperature is low.

It is a third object of the present invention to provide a multiform gas heat pump type of air conditioning system capable of providing the desired degree of superheat to gas refrigerant taken into a compressor even when performing the heating operation when the outside temperature is low.

It is a fourth object of the present invention to provide a multiform gas heat pump type of air conditioning system capable of recovering liquefied refrigerant accumulated inside an outdoor heat exchanger whose operation is temporarily suspended and prevent the insufficiency of the refrigerant.

SUMMARY OF THE INVENTION

In the present invention the following respective means are employed in order to solve the above problems.

The first embodiment of the multiform gas heat pump type of air conditioning system of the present invention comprises: a plurality of indoor units that are each provided with an indoor heat exchanger and that perform a heat exchange between air inside a room and refrigerant; an outdoor unit provided with a compressor driven by a gas engine and an outdoor heat exchanger for performing a heat exchange between outside air and the refrigerant; and a split flow control unit for controlling a flow direction of the refrigerant in each of the indoor units and for performing a selection switching between cooling and heating operations, wherein the outdoor heat exchanger is divided into a plurality of units that are connected in parallel, and there is provided a refrigerant supply switching means that controls the refrigerant flow in each division portion of the outdoor heat exchanger.

According to this multiform gas heat pump type of air conditioning system, it is possible to control the flow of the refrigerant in each of the divided portions in the outdoor heat exchanger that has been divided into a plurality of portions. Accordingly, the condensing performance or evaporation performance of the outdoor heat exchanger can be changed in stages corresponding to the number of divisions of the outdoor heat exchanger. As a result, it is possible to easily obtain a condensing performance or evaporation performance that each varies greatly in accordance with the operating state of each indoor unit that is selected as is appropriate from between all units performing the cooling operation, all units performing the heating operation, and some units performing the heating operation simultaneously with some units performing the cooling operation, using a low-cost system.

In this multiform gas heat pump type of air conditioning system, it is preferable that a radiator of the gas engine is provided adjacent to the outdoor heat exchanger, and that this radiator is divided into a plurality of units that are connected in parallel and there is provided a switching means that controls engine cooling water flow in each unit of the radiator.

As a result, engine waste heat obtained from the engine cooling water introduced into the radiator can be effectively utilized by stages corresponding to the number of divisions of the radiator.

Furthermore, in this multiform gas heat pump type of air conditioning system, it is preferable that control of the amount of outside air that is introduced is performed using an outdoor unit fan in the outdoor heat exchanger.

As a result, the condensing performance or evaporation performance of the outdoor heat exchanger can be adjusted by controlling the amount of air flow.

The second embodiment of the multiform gas heat pump type of air conditioning system of the present invention comprises: a plurality of indoor units that are each provided with an indoor heat exchanger and that perform a heat exchange between air inside a room and refrigerant; an outdoor unit provided with a compressor driven by a gas engine and an outdoor heat exchanger for performing a heat exchange between outside air and the refrigerant; and a split flow control unit for controlling a flow direction of the refrigerant in each of the indoor units and for performing a selection switching between cooling and heating operations, wherein in the outdoor unit, a water heat exchanger that heats the refrigerant by obtaining waste heat from engine cooling water used for cooling the gas engine is provided parallel with the outdoor heat exchanger, and when performing a warming operation during low outside temperatures that fulfill the conditions for frost formation, the refrigerant is evaporated and vaporized by the water heat exchanger.

In this case, the evaporation performance of the water heat exchanger can be changed over a wide range by controlling the amount of engine cooling water that is introduced.

According to the multiform gas heat pump type of air conditioning system such as this, because the water heat exchanger is provided parallel with the outdoor heat exchanger, during low outside temperature that meet the conditions for frost formation, the refrigerant can be evaporated using the water heat exchanger. As a result, a reduction in the heating performance caused by frost formation is prevented and a consistent excellent heating performance can be obtained.

The third embodiment of the multiform gas heat pump type of air conditioning system of the present invention comprises: a plurality of indoor units that are each provided with an indoor heat exchanger and that perform a heat exchange between air inside a room and refrigerant; an outdoor unit provided with a compressor driven by a gas engine and an outdoor heat exchanger for performing a heat exchange between outside air and the refrigerant; and a split flow control unit for controlling a flow direction of the refrigerant in each of the indoor units and for performing a selection switching between cooling and heating operations, in which the outdoor heat exchanger is divided into a plurality of units that are connected in parallel, and there is provided a refrigerant supply switching means that controls the refrigerant flow in each division portion of the outdoor heat exchanger, wherein in the outdoor unit, a water heat exchanger that heats the refrigerant by obtaining waste heat from engine cooling water used for cooling the gas engine is provided parallel with the outdoor heat exchanger, and a circulation amount of engine cooling water introduced into the water heat exchanger is controlled so that the degree of superheat of the refrigerant on an intake side of the compressor is kept within a predetermined range.

According to this multiform gas heat pump type of air conditioning system, because the amount of heating of the refrigerant can be adjusted by controlling the circulation amount of engine cooling water introduced into the water heat exchanger, even when the outside temperature is low, it is possible to supply the desired degree of superheat to the refrigerant that is evaporated and vaporized by the water heat exchanger. As a result, any reduction in the compression efficiency caused by two-phase gas and liquid refrigerant being taken into the compressor is prevented, and because the gas refrigerant supplied from the water heat exchanger is circulated in the refrigeration cycle, an excellent heating performance can be obtained and an improvement in the COP of the air conditioning system can be achieved.

In this case, it is desirable that the circulation amount of engine cooling water is controlled by calculating the degree of superheat for the refrigerant from a value detected by a low pressure detecting means that detects pressure on the intake side of the compressor and a value detected by a temperature detecting means that detects a refrigerant outlet temperature of the water heat exchanger.

The fourth embodiment of the multiform gas heat pump type of air conditioning system of the present invention comprises: a plurality of indoor units that are each provided with an indoor heat exchanger and that perform a heat exchange between air inside a room and refrigerant; an outdoor unit provided with a compressor driven by a gas engine and an outdoor heat exchanger for performing a heat exchange between outside air and the refrigerant; and a split flow control unit for controlling a flow direction of the refrigerant in each of the indoor units and for performing a selection switching between cooling and heating operations, in which the outdoor heat exchanger is divided into a plurality of units that are connected in parallel, and there is provided a refrigerant supply switching means that controls the refrigerant flow in each division portion of the outdoor heat exchanger, wherein a division portion of the outdoor heat exchanger that is in a state of suspended operation is made to communicate with an intake system of the compressor by an operation of the refrigerant supply switching means.

According to this multiform gas heat pump type of air conditioning system, as a result of the division portions of the outdoor heat exchanger that are in a suspended operation state being placed in communication with the intake system of the compressor by the operation of the refrigerant supply switching means, the saturation temperature of the refrigerant is lowered by the pressure reduction inside the division portions in the suspended operation state, resulting in the liquid refrigerant accumulated therein being evaporated and vaporized and suctioned into the compressor. Accordingly, because it is possible to effectively recover and utilize the liquid refrigerant accumulated in the suspended operation portions of the outdoor heat exchanger, any insufficiency of the refrigerant in the refrigeration cycle is prevented and excellent cooling and heating performances can be maintained.

DESCRIPTION OF THE PREFERRED EMBODIMENTS

First Embodiment

A description will now be given of the multiform gas heat pump type of air conditioning system according to the present invention with reference to FIGS. 1 to 10.

Figure 1:
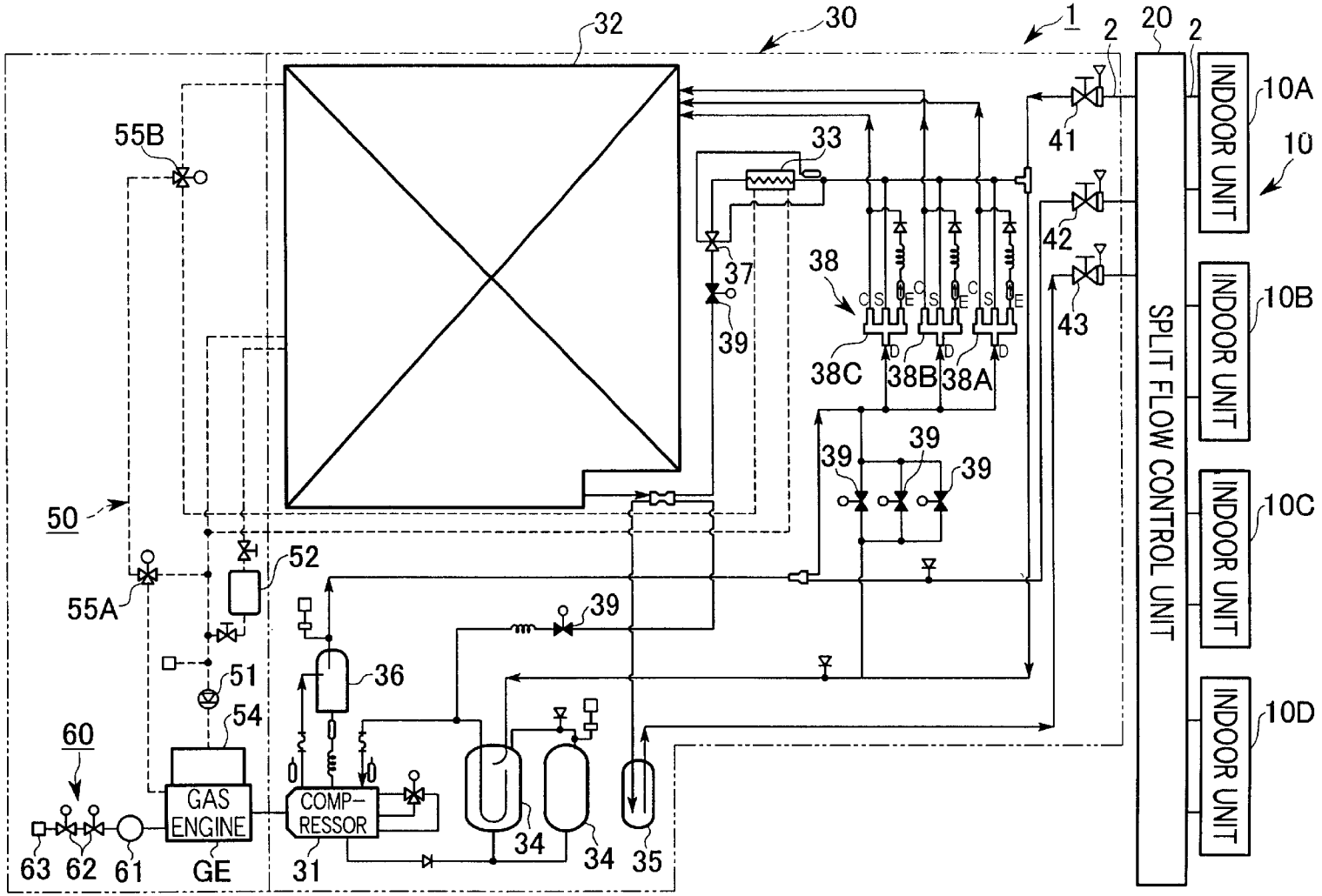
FIG. 1 is a view showing an embodiment of a multiform gas heat pump type of air conditioning system according to the present invention and shows a state in which all units are performing a cooling operation.

The multiform gas heat pump type of air conditioning system (abbreviated below to MGHP system) 1 shown in FIG. 1 is provided with a plurality of indoor units 10, a split flow controller 20 for controlling the flow direction of refrigerant in each indoor unit 10 and switching between cooling and heating operations, and an outdoor unit 30 having a compressor driven by a gas engine described below and an outdoor heat exchanger. In this MGHP system 1, each of the indoor units 10, the split flow control unit 20, and the outdoor unit 30 are connected respectively by refrigerant pipes 2.

Figure 2:
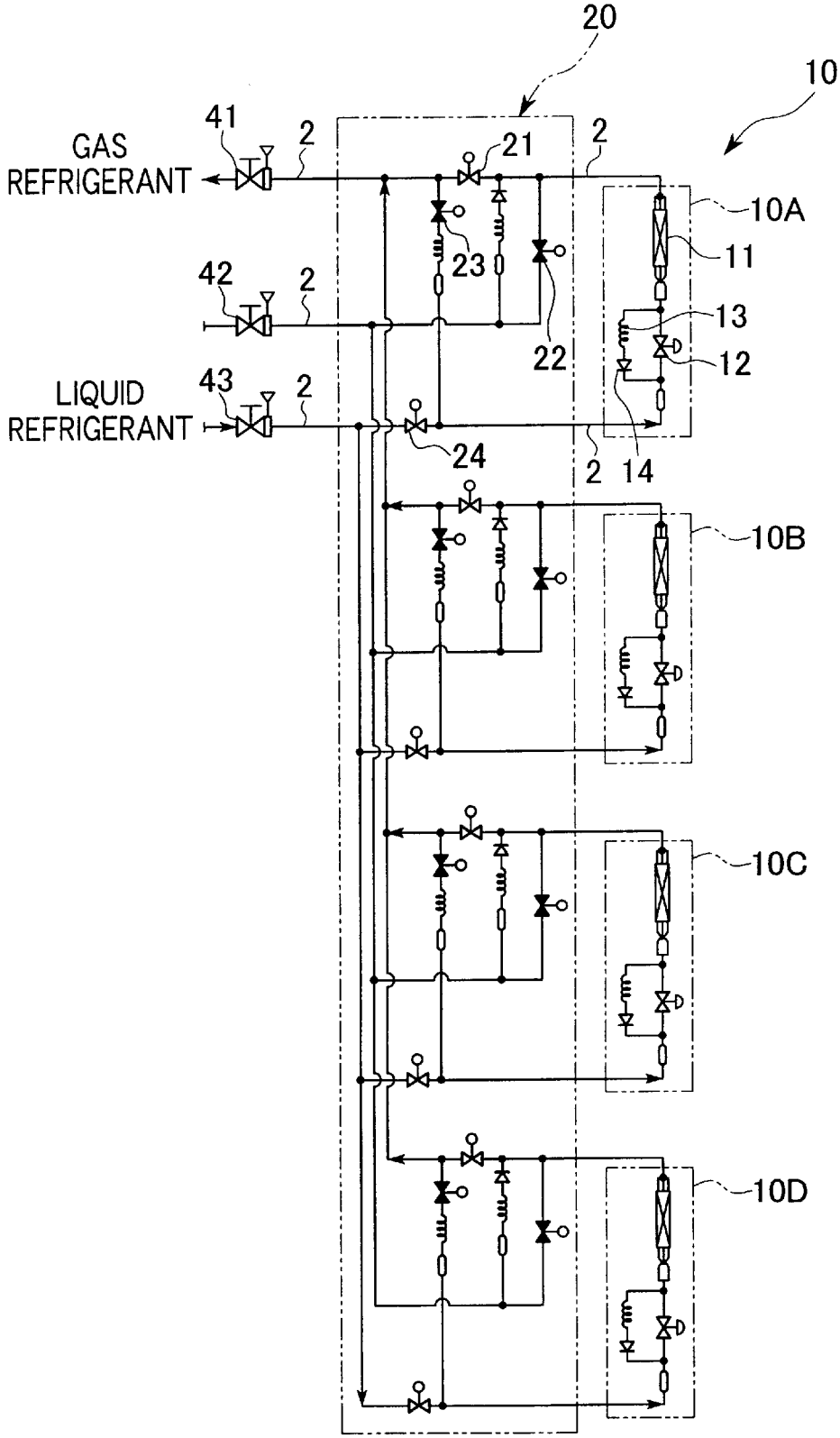
FIG. 2 is a view showing an internal structure of the split flow control unit and indoor unit shown in FIG. 1.

As is shown in FIG. 2, in each indoor unit 10 is provided an indoor heat exchanger 11 that functions as an evaporator that evaporates and vaporizes low temperature-low pressure liquid refrigerant and captures heat from air inside a room (i.e., indoor air) when performing a cooling operation, and functions as a condenser that condenses and liquefies high temperature-high pressure gas refrigerant and warms indoor air when performing a heating operation. Reference numeral 12 in the diagrams denotes an electronic expansion valve that functions as a diaphragm mechanism for the cooling operation, while reference numeral 13 denotes a capillary tube that functions as a diaphragm mechanism for the heating operation. Reference numeral 14 denotes a check valve.

In the examples shown in the diagrams four of the above described indoor units 10 are arranged in parallel as shown by reference numerals 10A, 10B, 10C, and 10D. Each of these indoor units 10A to 10D is positioned in an independent space to be air conditioned and a selection can be made by a switching operation of the split flow control unit 20 described below for all of the units to perform the cooling operation, all of the units to perform the heating operation, or (and this is referred to below as simultaneous heating and cooling operations) for each indoor unit to independently perform the cooling operation, the heating operation, or have its operation temporarily suspended.

The split flow control unit 20 is formed by refrigerant conduits that connect the indoor units 10 and the outdoor units 30, and by opening and closing valves such as electromagnetic valves that selectively switch the conduit through which the refrigerant is flowing and the direction in which the refrigerant is flowing inside the conduit.

In the example in the diagram, four electromagnetic valves 21, 22, 23, and 24 are provided in each of the indoor units 10. By switching the open/closed state of each of the electromagnetic valves 21 to 24 in accordance with the operating state (selected from one of the cooling operation, the heating operation, or a suspended operation) of each of the indoor units 10, it is possible to selectively switch the conduit that is connected to the outdoor unit 30 described below and through which the refrigerant is flowing as well as the flow direction of the refrigerant.

For each one of the indoor units 10, the split flow control unit 20 is also provided with two refrigerant pipes 2 used for connecting with the indoor unit and three refrigerant pipes 2 used for connecting with the outdoor unit 30 described below.

The interior of the outdoor unit 30 is split into two large structural portions. The first structural portion is centered on equipment such as a compressor and the outdoor heat exchanger, and together with the indoor unit 10 is the portion forming a refrigerant circuit. This portion is referred to below as a refrigerant circuit portion. The second structural portion is centered on a gas engine used to drive the compressor and is provided with the equipment that accompanies this. This portion is referred to below as a gas engine portion.

In the refrigerant circuit portion are provided such apparatuses as a compressor 31, an outdoor heat exchanger 32, a water heat exchanger 33, an accumulator 34, a receiver 35, an oil separator 36, a diaphragm mechanism 37, a four-way valve 38, an electromagnetic valve 39, and a check valve 40. Furthermore, in order to connect with the three refrigerant pipes 2 provided in the split flow control unit 20, the refrigerant circuit portion is provided with three refrigerant pipes 2 for connecting with the split flow control unit that are provided respectively with a first operating valve 41, a second operating valve 42, and a third operating valve 43.

The compressor 31 is operated using the gas engine GE described below as a drive source to compress low temperature-low pressure gas refrigerant supplied from either the indoor heat exchanger 11 or the outdoor heat exchanger 32 and discharge it as the high temperature-high pressure gas refrigerant. The result of this is that when the system is performing the cooling operation, even if the outside temperature is high, it is possible to discharge heat from the refrigerant to the outside air through the outdoor heat exchanger 32. In addition, when the system is performing the cooling operation, it is possible to provide heat from the refrigerant to the indoor air through the indoor heat exchanger 11.

The outdoor heat exchanger 32 functions during the cooling operation as a condenser that condenses the high temperature-high pressure gas refrigerant and discharges heat to the outside air. In contrast, during the heating operation, the outdoor heat exchanger 32 functions as an evaporator that evaporates and vaporizes the low temperature-low pressure liquid refrigerant and captures heat from the outside air. Namely, during both heating and cooling operations, the outdoor heat exchanger 32 performs the opposite action to the previously described indoor heat exchanger 11.

The outdoor heat exchanger 32 in the present embodiment has a structure in which the heat exchanging portion is divided into a plurality of units that are connected in parallel. In the example in the drawings, the outdoor heat exchanger 32 is divided into four units shown by reference numerals 32A, 32B, 32C, and 32D.

The outdoor heat exchanger 32 is positioned adjacent to a radiator 53 of the gas engine GE that is described below. The radiator 53 is a heat exchanger that performs heat exchange with the outside air on the engine cooling water of the gas engine GE so as to cool the cooling water. Accordingly, if, for example, the heating operation is being performed when the outside temperature is low, by selectively switching the rotation direction of an external unit fan 44, the outdoor heat exchanger 32 functioning as the evaporator is able to perform a heat exchange with the outside air that has risen in temperature by passing through the radiator 53. As a result, it is possible to increase the evaporation performance of the outdoor heat exchanger 32.

The water heat exchanger 33 is provided in parallel with the outdoor heat exchanger 32 in order that the refrigerant recovers heat from the engine cooling water of the gas engine GE described below. Namely, during a heating operation, the refrigerant does not rely solely on the heat exchange occurring in the outdoor heat exchanger 32, but is also able to recover waste heat from the engine cooling water of the gas engine GE. Therefore, it is possible to further increase the effectiveness of the heating operation. In addition, because the water heat exchanger 33 is provided in parallel with the outdoor heat exchanger 32, the water heat exchanger 33 is also able to be used independently as a heat exchanger (i.e., an evaporator) for evaporating and vaporizing the refrigerant.

The accumulator 34 is provided in order to accumulate the liquid component contained in the gas refrigerant taken into the compressor 31.

The receiver 35 is provided in order to separate into gas and liquid the refrigerant that is liquefied by the heat exchanger functioning as the condenser, and accumulate surplus refrigerant that has been liquefied in the refrigeration cycle.

The oil separator 36 is provided in order to separate and return to the compressor 31 any oil portion contained in the refrigerant.

The diaphragm mechanism 37 is provided in order to decompress and expand condensed high temperature-high pressure liquid refrigerant and turn it into the low temperature-low pressure liquid refrigerant. In the examples in the drawings, depending on the objective, either an electronic expansion valve, an expansion valve, or a capillary tube is used as the diaphragm mechanism 37.

The four-way valve 38 is provided in the refrigerant pipe 2 and selectively switches the flow passage and flow direction of the refrigerant. Together with the electromagnetic valve 39 and the check valve 40 it forms a refrigerant supply switching means for the outdoor heat exchanger 32 that has been divided into a plurality of units.

Four ports D, C, S, and E are provided for the four-way valve 38. The port D is connected by a refrigerant pipe 2 to the discharge side of the compressor 31, the port C is connected by a refrigerant pipe 2 to the outdoor heat exchanger 32, and the port S is connected by a refrigerant pipe 2 to the intake side of the compressor 31. In addition, the port E is connected to a point partway along the refrigerant pipe 2 connecting the port C and the outdoor heat exchanger 32. In the example in the drawings three four-way valves 38, denoted by reference numerals 38A, 38B, and 38C, are provided to correspond to the outdoor heat exchanger 32 that is divided into four units.

The first four-way valve 38A is connected to the outdoor heat exchanger (heat exchange portion) denoted by reference numeral 32A. This outdoor heat exchanger 32A can be used independently and because the refrigerant pipe is provided with an electronic expansion valve as the diaphragm mechanism 37 variable control of the heat exchange performance is possible.

The second four-way valve 38B is connected to two outdoor heat exchangers (heat exchange portions) denoted by reference numerals 32*b* and 32C. In this case, the outdoor heat exchangers 32B and 32C are usually both used at the same time and the usage of each is the same.

The third four-way valve 38C is connected to the outdoor heat exchanger (heat exchange portion) denoted by reference numeral 32D. This outdoor heat exchanger 32D can be used independently.

Thus, if the outdoor heat exchangers 32A to 32D are divided equally the heat exchange performance can be suitably selected to match the conditions of use. Namely, the heat exchange performance is 25% if the outdoor heat exchanger 32A is used alone. The heat exchange performance is 50% if the outdoor heat exchangers 32B and 32C are used together. The heat exchange performance is 75% if the three outdoor heat exchangers 32B to 32D are used together, and the heat exchange performance is 100% if all the outdoor heat exchangers 32A to 32D are used together.

Moreover, by switching the open and closed states of the four-way valves 38A to 38D and the electromagnetic valve 39, it is also possible to switch the flow direction of the refrigerant. As a result, it is possible to use the outdoor heat exchangers 32A and 32D each independently as the evaporator or condenser, or to use the outdoor heat exchangers 32B and 32C as an integrated unit operating as the evaporator or condenser.

In the gas engine portion, the gas engine GE is provided at the center portion thereof, and a water cooling system 50 and a fuel intake system 60 are also provided as well as an exhaust gas system and an engine oil system that have been omitted from the drawings.

The gas engine GE is connected to the compressor 31 which is located inside the refrigerant circuit by a shaft or belt or the like so that drive power from the gas engine GE is transmitted to the compressor 31.

The cooling water system 50 is equipped with a water pump 51, a reservoir tank 52, a radiator 53 and the like, and is a system for cooling the gas engine GE using engine cooling water that circulates around the circuit formed by connecting the above portions by pipes (shown by the broken line in the drawings). The water pump 51 is provided in order to circulate the gas engine GE cooling water around the circuit. The reservoir tank 52 temporarily stores the surplus portion of the cooling water flowing around the circuit or else supplies cooling water when the amount thereof in the circuit is insufficient. The radiator 53 is formed integrally with the outdoor heat exchanger 32 and is provided in order to discharge heat that is captured from the gas engine GE by the engine cooling water to the outside air.

In the example in the drawings, the radiator 53 is divided into four units, denoted by reference numerals 53A, 53B, 53C, and 53D, that are connected in parallel in the same way as the outdoor heat exchanger 32. By also providing the electromagnetic valve 39 in the radiator 53, it is possible to select the radiators 53A and 53D for independent use or the radiators 53B and 53C for simultaneous use.

In addition to the structure described above, the cooling water system 50 is also equipped with an exhaust gas heat converter 54 for collecting heat from the exhaust gas discharged by the gas engine GE in the engine cooling water. The water heat exchanger 33 described above is also arranged in the cooling water system 50 so as to bridge both the refrigerant circuit portion and the cooling water system 50. Namely, during the heating operation, the engine cooling water not only captures heat from the gas engine GE but also recovers heat from the exhaust gas. In addition, this recovered heat can be supplied to the refrigerant from the engine cooling water by passing through the water heat exchanger 33.

The control of the flow amount of the engine cooling water in the cooling water system 50 is performed by flow amount control valves 55A and 55B placed in two locations.

The fuel intake system 60 is equipped with a gas regulator 61, a gas electromagnetic valve 62, a gas connection aperture 63 and the like and is used to supply town gas such as liquid natural gas (LNG) to the gas engine GE as gas fuel. The gas regulator 61 is provided in order to adjust the delivery pressure of the gas fuel supplied from the outside via the gas electromagnetic valve 62 and the gas connection aperture 63. The gas fuel whose pressure is adjusted by the gas regulator 61 is mixed with air taken in from an air intake aperture (not shown), and is then supplied to the combustion chamber of the gas engine GE.

Next, the process for performing the indoor heating or cooling operation using the MGHP 1 having the structure described above will be described. Note that in the drawings the open and closed state of each type of valve is shown by inking in closed valves, while the flow direction of the refrigerant is indicated by an arrow.

Figure 3:
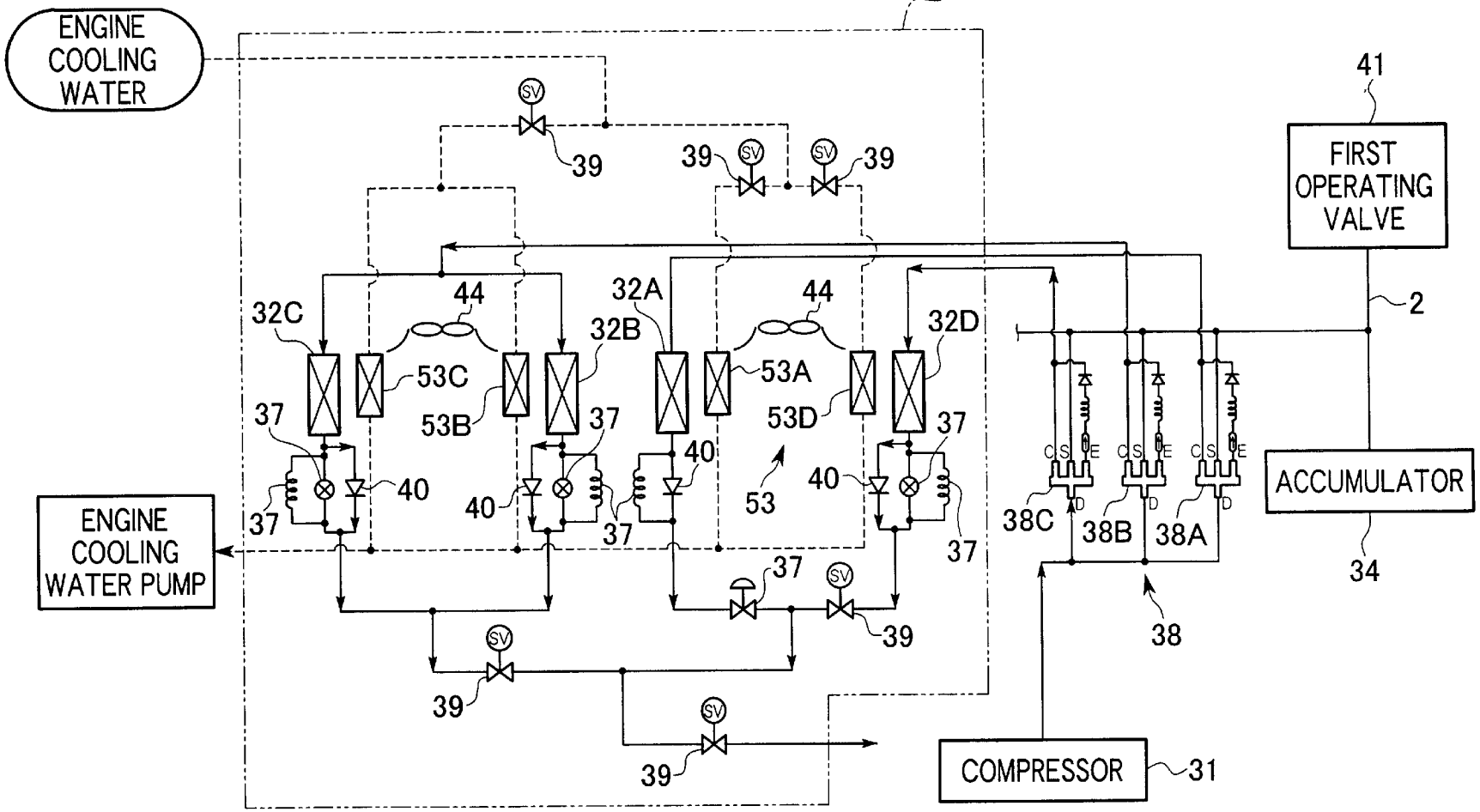
FIG. 3 is a view showing an example of a structure of the area around the outdoor heat exchanger shown in FIG. 1.

Firstly, a description will be given of when all of the indoor units 10A to 10D are operating as coolers with reference made to FIGS. 1 to 3. In this case, the ports D and C communicate in each of the four-way valves 38A to 38C of the refrigerant circuit portion 30, while the discharge side of the compressor 31 is connected to the outdoor heat exchanger 32. In this state high temperature-high pressure gas refrigerant discharged from the compressor 31 is sent via the four-way valve 38 to the outdoor heat exchanger 32 functioning as the condenser.

After the high temperature-high pressure gas refrigerant has been condensed and liquefied by the outdoor heat exchanger 32, the gas refrigerant discharges heat to the outside air and becomes high temperature-high pressure liquid refrigerant. As is shown in FIG. 3, this liquid refrigerant is guided to the receiver 35 via the check valve 40. The liquid refrigerant that is separated into gas and liquid in the receiver 35 then flows into the split flow control unit 20 via the third operating valve 43.

The high temperature-high pressure liquid refrigerant that has flowed into the split flow control unit 20 is guided to the electronic expansion valve 12 after passing through the electromagnetic valve 24. In the process of passing through this electronic expansion valve 12, the liquid refrigerant is decompressed and becomes low temperature-low pressure liquid refrigerant, and is then sent to the indoor heat exchanger 11 that is functioning as the evaporator.

The low temperature-low pressure liquid refrigerant that has been sent to the indoor heat exchanger 11 captures heat from the indoor air, and is evaporated and vaporized. In this process, the refrigerant cools the indoor air and changes to low temperature-low pressure gas refrigerant. The refrigerant is then returned to the split flow control unit 20 and is then further sent to the refrigerant circuit portion of the outdoor unit 30 via the first operating valve 41.

The low temperature-low pressure gas refrigerant that has been sent to the refrigerant circuit portion is introduced into the accumulator 34 and the liquid component has been separated out, and then the refrigerant is fed into the compressor 31. The gas refrigerant that is introduced into the compressor 31 is compressed by the operation of the compressor 31 so that it again turns into the high temperature-high pressure gas refrigerant and is again sent to the outdoor heat exchanger 32. Consequently, a refrigeration cycle in which the state of the refrigerant is repeatedly changed is created.

Figure 4:
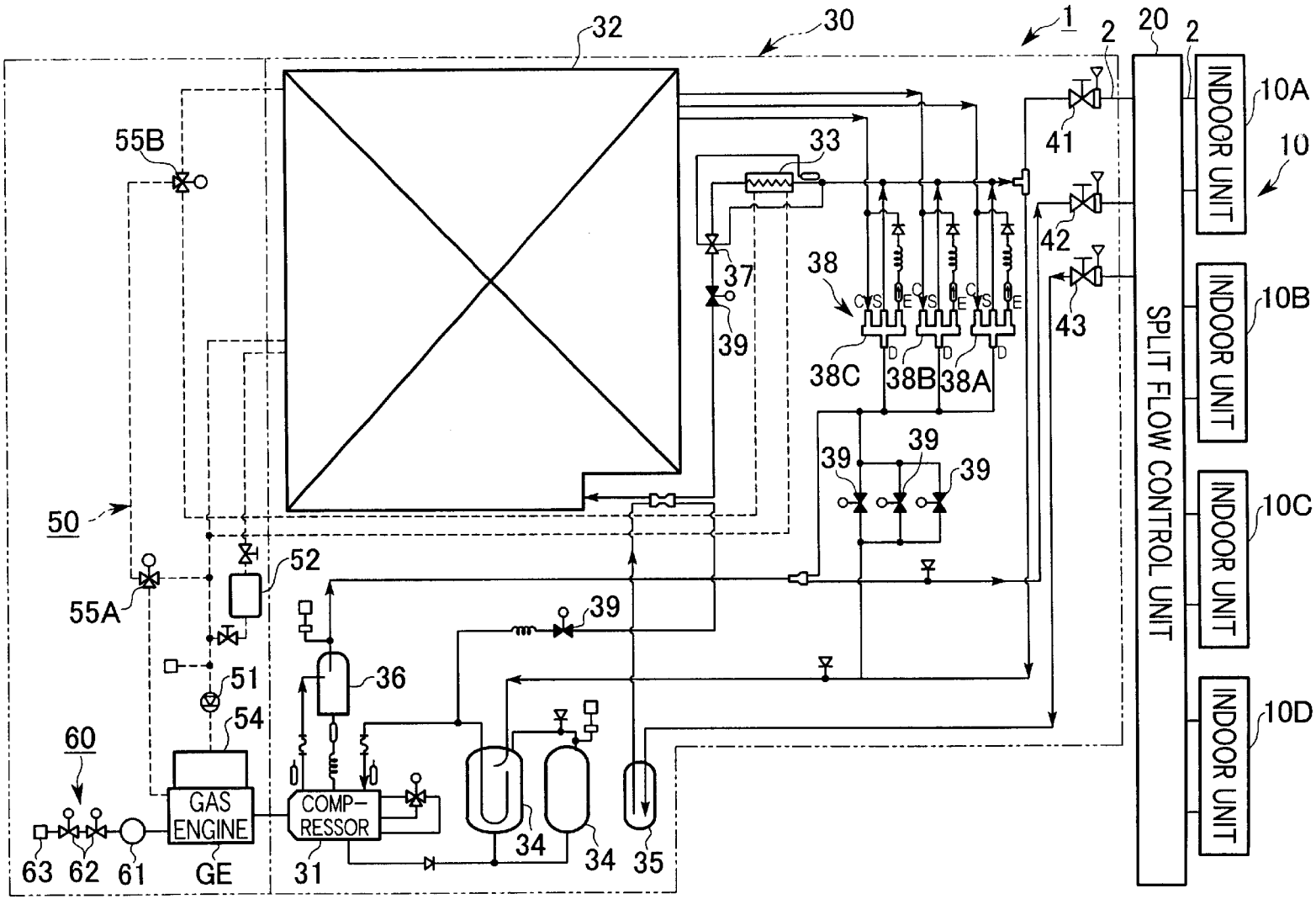
FIG. 4 is a view showing an embodiment of a multiform gas heat pump type of air conditioning system according to the present invention and shows a state in which all units are performing a heating operation.
Figure 5:
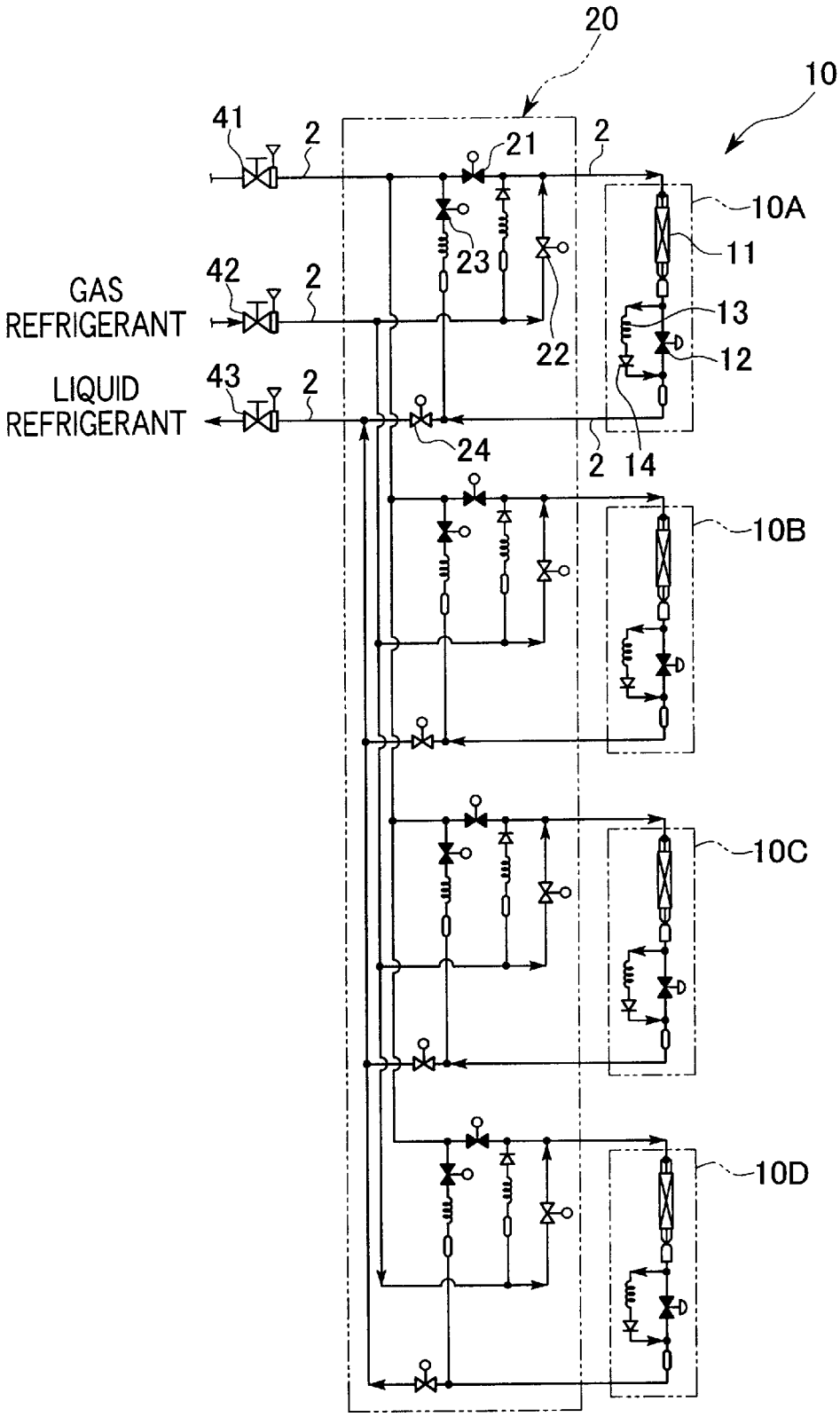
FIG. 5 is a view showing an internal structure of the split flow control unit and indoor unit shown in FIG. 4.
Figure 6:
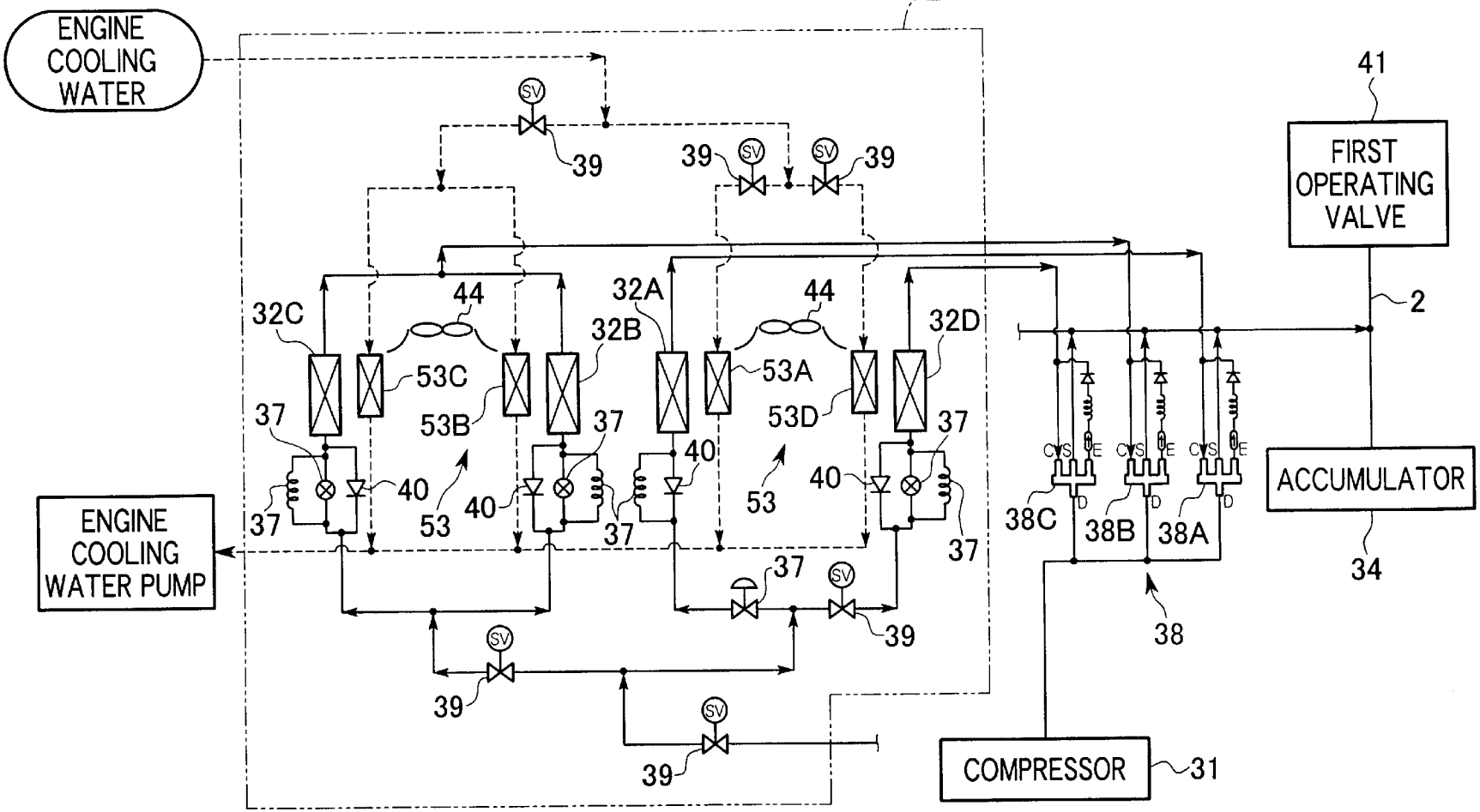
FIG. 6 is a view showing an example of a structure of the area around the outdoor heat exchanger shown in FIG. 4.

Next, Firstly, a description will be given of when all of the indoor units 10A to 10D are operating as heaters with reference made to FIGS. 4 to 6.

In this case, the ports C and S communicate in each of the four-way valves 38A to 38C of the refrigerant circuit portion, while the discharge side of the compressor 31 is connected to the indoor heat exchanger 11. In this state, high temperature-high pressure gas refrigerant discharged from the compressor 31 is sent via the second operating valve 42 to the split flow control unit 20. The refrigerant that has been guided into the split flow control unit 20 passes through the electromagnetic valve 22 and is sent to the indoor heat exchanger 11 functioning as a condenser of the respective indoor units 10A to 10D.

The high temperature-high pressure gas refrigerant undergoes a heat exchange with the indoor air in the indoor heat exchanger 11 and is condensed and liquefied. In this process, the gas refrigerant discharges heat and warms the indoor air, thereafter becoming high temperature-high pressure liquid refrigerant. This liquid refrigerant is decompressed by passing through the capillary tube 13 and changes into low temperature-low pressure liquid refrigerant. The refrigerant is then returned to the split flow control unit 20 via the check valve 14.

The low temperature-low pressure liquid refrigerant that has been taken into the split flow control unit 20 is sent to the refrigerant circuit portion of the outdoor unit 30 via the electromagnetic valve 24 and the third operating valve 43.

The liquid refrigerant sent to the refrigerant circuit portion 30 is separated into gas and liquid in the receiver 35 and only the liquid portion is sent to the outdoor heat exchanger 32 functioning as the evaporator. Before this liquid refrigerant enters the outdoor heat exchanger 32, it is again decompressed by passing through a capillary tube provided as the diaphragm mechanism 37. Note that because the electromagnetic valve 39 provided in the refrigerant pipe 2 is closed, there is no inflow of the low temperature-low pressure liquid refrigerant into the liquid heat exchanger 33 provided parallel with the outdoor heat exchanger 32.

In the outdoor heat exchanger 32, the low temperature-low pressure liquid refrigerant captures heat from the outside air and is evaporated and vaporized to become low temperature-low pressure gas refrigerant. At this time, if high temperature engine cooling water is fed to the radiator 53, it is possible to efficiently evaporate and vaporize the liquid refrigerant using waste heat from the engine.

The refrigerant that has thus turned into the low temperature-low pressure gas is guided to the accumulator 34 from the port C of the four-way valve 38 through the port S. After the liquid component has been separated out, the refrigerant is then taken into the compressor 31. The gas refrigerant that is taken into the compressor 31 is compressed by the operation of the compressor 31, and is sent to the indoor heat exchanger 11 after becoming the high temperature-high pressure gas refrigerant again. Consequently, a refrigeration cycle in which the state of the refrigerant is repeatedly changed is created.

Figure 7:
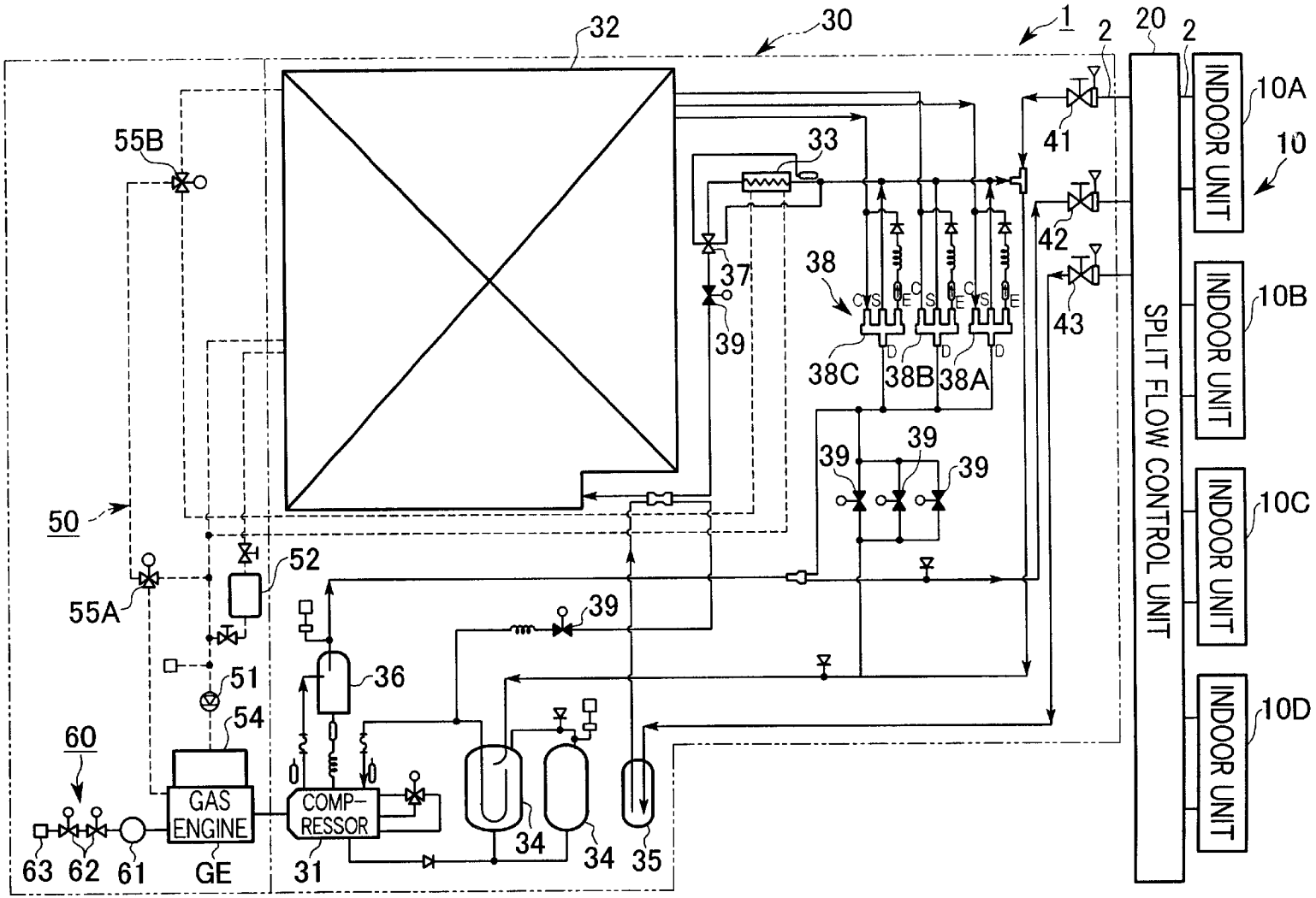
FIG. 7 is a view showing an embodiment of a multiform gas heat pump type of air conditioning system according to the present invention and shows a state in which both cooling and heating operations are being performed simultaneously.
Figure 8:
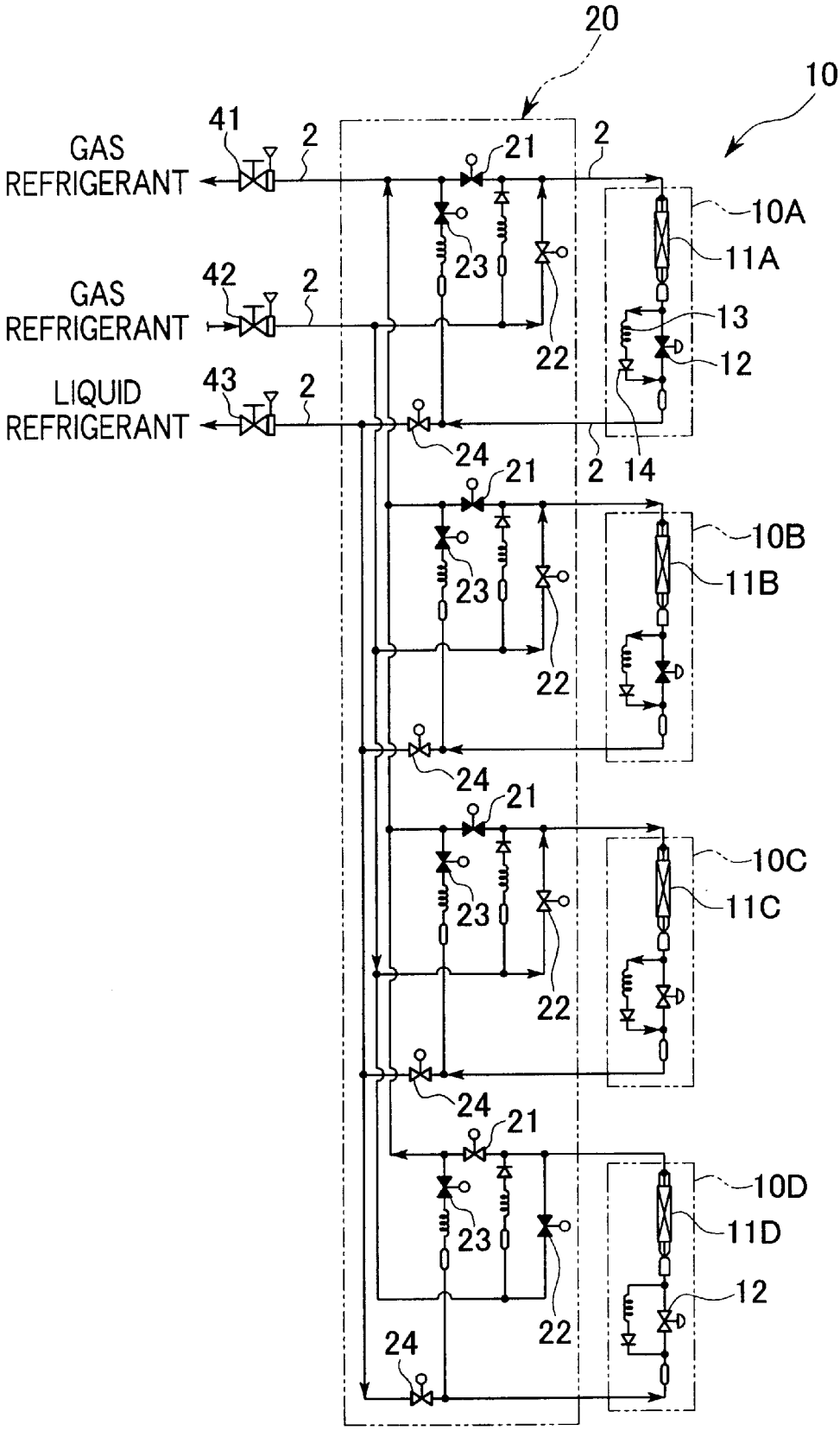
FIG. 8 is a view showing an internal structure of the split flow control unit and indoor unit shown in FIG. 7.
Figure 9:
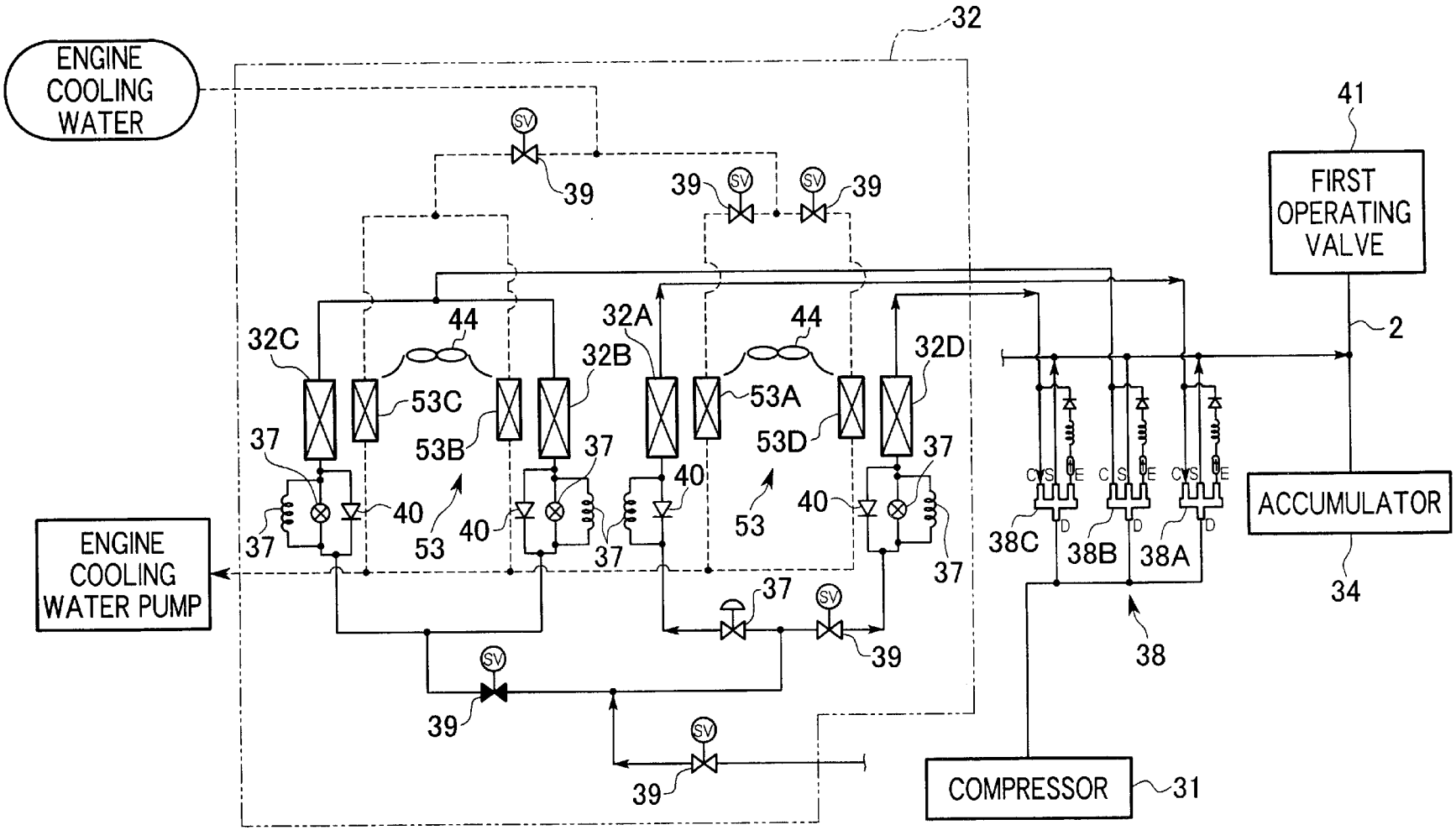
FIG. 9 is a view showing an example of a structure of the area around the outdoor heat exchanger shown in FIG. 8.

A description will now be given of when the indoor units 10A to 10D are performing simultaneous heating and cooling operations with reference made to FIGS. 7 to 9. Note that, in the simultaneous heating and cooling operations described here, an example is given of when the cooling operation is mainly performed. Specifically, an example is given of when a set of three indoor units 10A to 10C are operating as the heaters and the remaining set of one indoor unit 10D operates as the cooler.

In this case, the ports C and S communicate in the four-way valves 38A and 38C of the refrigerant circuit portion, while the discharge side of the compressor 31 is connected to the indoor heat exchanger 11 of the indoor units 10A to 10C.

In this state, high temperature-high pressure gas refrigerant discharged from the compressor 31 is sent to the split flow control unit 20 via the second operating valve 42. The refrigerant guided into the split flow control unit 20 is sent, via the respective electromagnetic valve 22 corresponding to the respective indoor unit 10A to 10C, to the indoor heat exchangers 11A to 11C functioning as the condensers in the respective indoor units 10A to 10C.

The high temperature-high pressure gas refrigerant then performs a heat exchange with the indoor air in the indoor heat exchangers 11A to 11C and becomes condensed and liquefied. In this process, the gas refrigerant discharges heat and warms the indoor air, thereafter becoming high temperature-high pressure liquid refrigerant. This refrigerant is decompressed by passing through the capillary tube 13 and becomes low temperature-low pressure liquid refrigerant. The refrigerant is then returned to the split flow control unit 20 via the check valve 14.

The low temperature-low pressure liquid refrigerant that has flowed into the split flow control unit 20 is sent to the refrigerant circuit portion of the outdoor unit 30 via the electromagnetic valve 24 and the third operating valve 43.

On the other hand, in the cooling operation of the indoor unit 10D, the corresponding electromagnetic valves 21 and 24 in the split flow control unit 20 are set to open. Therefore, a part of the flow of low temperature-low pressure liquid refrigerant sent from the indoor units 10A to 10C to the outdoor unit 30 is separated on the upstream side of the third operating valve 43, passes through the electromagnetic valve 24 and the electronic expansion valve 12, and is sent to the indoor heat exchanger 11D functioning as the evaporator.

The low temperature-low pressure liquid refrigerant sent to the indoor heat exchanger 11D is evaporated and vaporized by capturing heat from the indoor air and cools the indoor air. In this process, as it cools the indoor air it changes to low temperature-low pressure gas refrigerant and is returned to the split flow control unit 20. The low temperature-low pressure gas refrigerant inside the split flow control unit 20 passes through the electromagnetic valve 21 and is sent from the first operating valve 41 to the refrigerant circuit portion of the outdoor unit 30.

The remainder of the liquid refrigerant that has been flowed to the indoor unit 10D is sent from the third operating valve 43 to the refrigerant circuit portion 30. This refrigerant is separated into gas and liquid by passing through the receiver 35 and the liquid refrigerant alone is sent to the outdoor heat exchanger 32 functioning as the evaporator. Before entering the outdoor heat exchanger 32, this liquid refrigerant is decompressed again by passing through the capillary tube provided as the diaphragm mechanism 37.

It should be noted that the evaporation performance required in the outdoor heat exchanger 32 does not have to be as high as when all units are performing the heating operation. Namely, in the four sets of indoor units 10A to 10D that are provided, because three sets are operating as heaters and the remaining one set is operating as a cooler, the required evaporation performance can be covered by a total evaporation performance obtained from using approximately 50% of the outdoor heat exchange units 32A to 32D that have been divided into four and from the indoor heat exchanger 11D that is operated as the cooler. Therefore, in this example, the outdoor heat exchangers 32A and 32D are used and the operations of the remaining 50% of the outdoor heat exchangers, 32B and 32C, are suspended.

Accordingly, the low temperature-low pressure liquid refrigerant captures heat from the outside air during the process of flowing through the outdoor heat exchangers 32A and 32D, and is evaporated and vaporized to become low temperature-low pressure gas refrigerant. At this time, if high temperature engine cooling water is supplied to the radiator 53, it is possible to efficiently evaporate and vaporize the liquid refrigerant using engine waste heat.

The refrigerant that has changed into the low temperature-low pressure gas in this manner is guided from the ports C of the four-way valves 38A and 38C through the port S to the accumulator 34. The low temperature-low pressure gas refrigerant that has been evaporated and vaporized in the indoor heat exchanger 11D merges with the gas refrigerant guided to the accumulator 34 from the four-way valves 38A and 38C at the downstream side of the first operating valve 41 and is guided in the same way to the accumulator 34. After the liquid component has been separated out from of the low temperature-low pressure gas refrigerant guided to the accumulator 34, the low temperature-low pressure gas refrigerant is introduced into the compressor 31. The gas refrigerant introduced into the compressor 31 is compressed by the operation of the compressor 31 so as to change into the high temperature-high pressure gas refrigerant, and then the refrigerant is then sent again to the internal heat exchanger 11. As a result, a refrigeration cycle in which the state of the refrigerant is repeatedly changed is created.

In this manner, when cooling and heating operations are being performed simultaneously, the operating mode of the respective outdoor heat exchangers 32A to 32D, which have been divided into four, can be switched selectively between a condenser mode, an evaporator mode, and a suspended operation mode, in accordance with the operating state of the indoor units 10A to 10D, by manipulating the four-way valve 38 and the electromagnetic valve 39.

Figure 10:
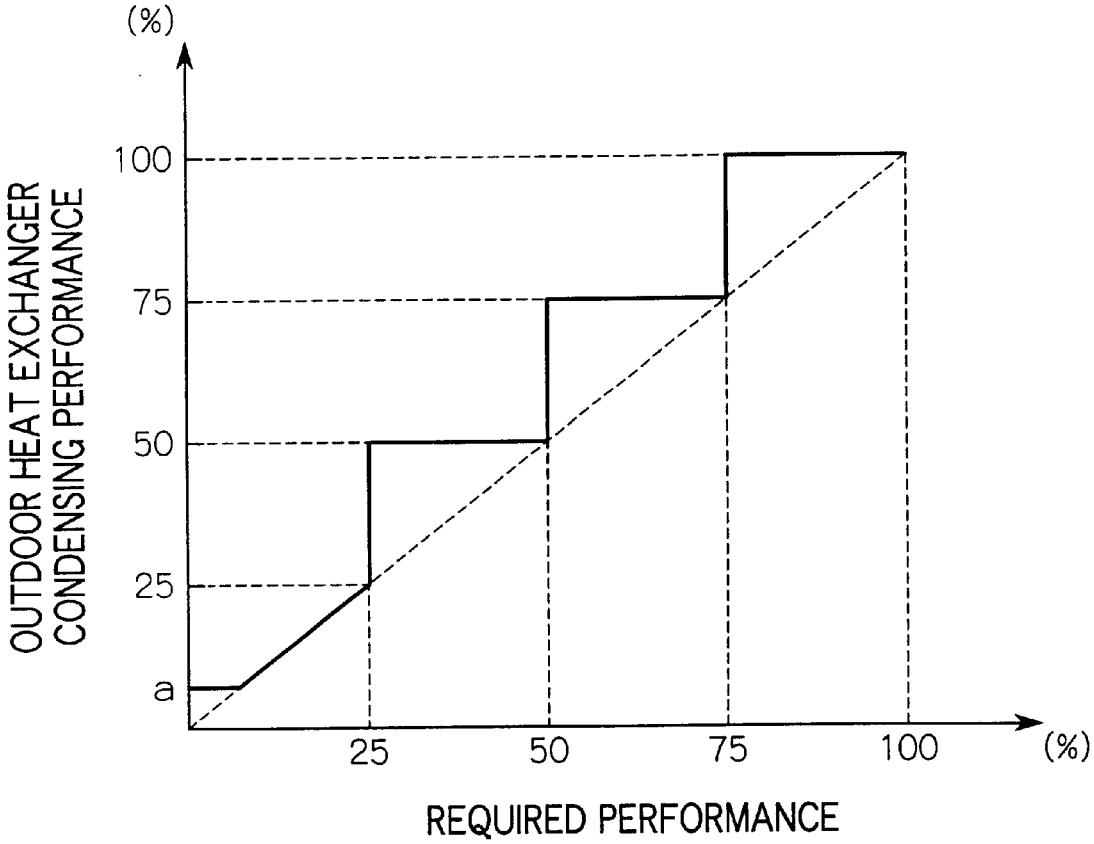
FIG. 10 is a view showing condensation performance characteristics of the outdoor heat exchanger shown in an embodiment of the present invention.

Namely, when the outdoor heat exchangers 32A to 32D, which have been divided into four, are used as condensers, as is shown by the solid line in FIG. 10, the condensing performance is characterized by being able to change in stages in accordance with the number of outdoor heat exchangers 32A to 32D that are used. In this case, the condensing performance also increases proportionally in the area in which the required performance is from a% to 25%. This is because the outdoor heat exchanger 32A, in which an electronic expansion valve having an adjustment function is employed as the diaphragm mechanism 37, is used independently. Note that the minimum value for the condensing performance is determined by the adjustment range of the electronic expansion valve.

In the example shown in FIG. 10, if the required performance is 25% or more the operating ranges of the outdoor heat exchangers 32A to 32D are set such that the condensing performance of 50% is obtained by the simultaneous use of two outdoor heat exchangers. In this case, by continually using the outdoor heat exchangers 32B and 32C simultaneously the number of electromagnetic valves 39 which are needed for switching the selection can be reduced. Note that, in order to lower costs, an expansion valve with no adjustment function is used as the diaphragm mechanism 37 in this case. Therefore, it is not possible to proportionally control the condensing performance.

The operating modes of the outdoor heat exchangers 32A to 32D are set such that three outdoor heat exchangers are used and the condensing performance of 75% is obtained when the required performance is 50% or more. In this case, in addition to the outdoor heat exchangers 32B and 32C for obtaining this 50% condensing performance, the outdoor heat exchanger 32D is additionally used.

Furthermore, the operating modes of the outdoor heat exchangers 32A to 32D are set such that the total number of outdoor heat exchangers 32A to 32D which have been divided into four are used and the condensing performance of 100% is obtained when the required performance is 75% or more.

Note that when the units are used as the evaporator, the evaporation performance exhibits the same characteristics as the above described condensing performance.

It is to be understood that the number of divisions of the outdoor heat exchanger 32 is not limited to four and can be appropriately set in accordance with the number of indoor units 10, the requirements of the simultaneous heating and cooling operations, and the like. Moreover, if an electronic expansion valve having an adjustment function is used for all of the diaphragm mechanisms 37, then proportional control becomes possible over substantially the entire range. Namely, it is possible to use electronic expansion valves having the adjustment function for all of the diaphragm mechanisms 37 or, alternatively, to use expansion valves with no adjustment function for all of the diaphragm mechanisms 37.

In this manner, when all of the units are performing a cooling operation, the number of indoor heat exchangers 11A to 11D that are functioning as the evaporators by performing the cooling operation can be made to match the number of outdoor heat exchangers 32A to 32D that are functioning as the condensers. When all units are made to perform a heating operation, the number of indoor heat exchangers 11A to 11D that are functioning as the condensers by performing the heating operation can be made to match the number of outdoor heat exchangers 32A to 32D that are functioning as the evaporators.

Furthermore, when performing heating and cooling operations simultaneously, the number or the combination of the divided outdoor heat exchangers 32 are set such that the evaporation performance of the indoor heat exchangers 11 and the outdoor heat exchangers 32 which function as the evaporators balances the condensing performance of the indoor heat exchangers 11 and the outdoor heat exchangers 32 which function as the condensers. Note that, if, for example, four sets of indoor heat exchangers 11 are provided and the number of units performing the heating operation is the same as the number of units performing the cooling operation, namely, two sets each, then because the performance is balanced between the indoor heat exchangers 11, it is possible to suspend the operation of all of the outdoor heat exchangers 32.

In the above described embodiment, the radiator 53 is divided into four units in the same way as the outdoor heat exchanger 32. Therefore, by opening and closing the electromagnetic valve 39, it becomes possible to selectively introduce the engine cooling water into the divided portion of the radiator 53 which using the outdoor heat exchanger 32 as the evaporator, and to effectively use engine waste heat in stages in accordance with the number of divisions of the radiator 53.

Moreover, because the outside air introduction capacity is changed by controlling the operating speed of the outdoor unit fan 44, in addition to the adjustment in stages that is achieved by switching the number of divided portions that are used, adjustment achieved using the outside air introduction capacity is also possible in the heat conversion performance of the outdoor heat exchanger 32 described above.

Second Embodiment

Figure 11:
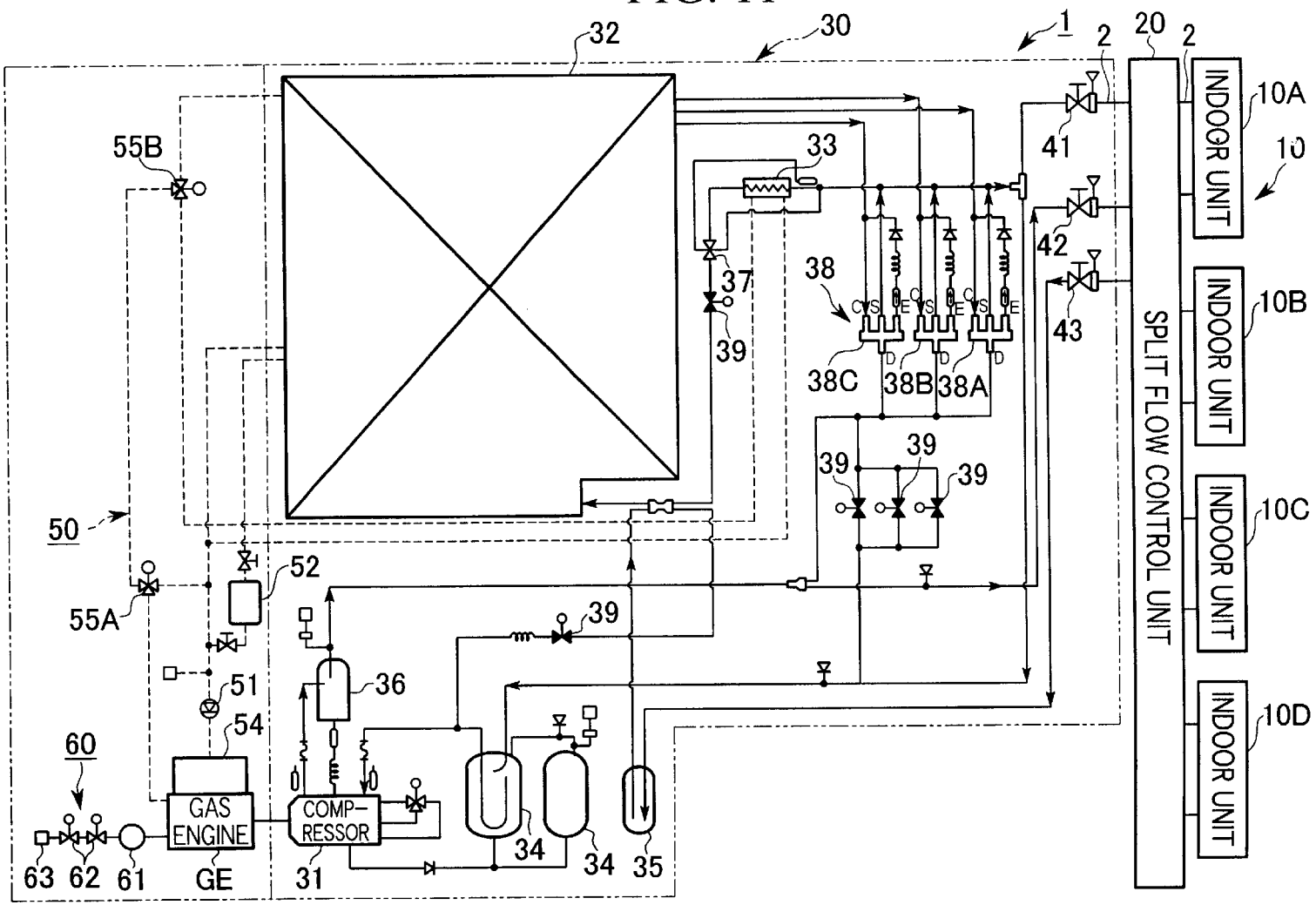
FIG. 11 is a view showing an embodiment of a multiform gas heat pump type of air conditioning system according to the present invention and shows a state in which all units are performing a heating operation when the outside temperature is low.

The second embodiment of the multiform gas heat pump type of air conditioning system of the present invention will now be described with reference made to FIG. 11.

In the second embodiment, using an MGHP 1 having the structure described in the first embodiment, a case is described in which all of the indoor units 10A to 10D perform the heating operation during low outside temperatures that fulfill the conditions for frost formation.

In this case as well, in the same manner as when all units are performing a normal heating operation as described above, the discharge side of the compressor 31 is connected to the indoor heat exchanger 11. In this state, high temperature-high pressure gas refrigerant that is discharged from the compressor 31 is sent via the second operating valve 42 to the split flow control unit 20. As is shown in FIG. 5, the refrigerant that has been sent into the split flow control unit 20 passes through the electromagnetic valve 22 and is sent to the indoor heat exchangers 11 functioning as condensers of the respective indoor units 10A to 10D.

The high temperature-high pressure gas refrigerant performs a heat exchange with the indoor air in the indoor heat exchanger 11 and is condensed and liquefied. In this process, after the gas refrigerant has discharged heat and warmed the indoor air it becomes high temperature-high pressure liquid refrigerant. This liquid refrigerant is decompressed by passing though the capillary tube 13 so as to become low temperature-low pressure liquid refrigerant, and is returned to the split flow control unit 20 via the check valve 14.

The low temperature-low pressure liquid refrigerant that has flowed into the split flow control unit 20 is sent through the electromagnetic valve 24 and the third operating valve 43 to the refrigerant circuit portion of the outdoor unit 30. The liquid refrigerant sent to the refrigerant circuit portion 30 is separated into gas and liquid by passing through the receiver 35, and only the liquid refrigerant is sent to the water heat exchanger 33. At this time, the electromagnetic valve 39 provided on the intake side of the outdoor heat exchanger 32 is closed.

This liquid refrigerant is again decompressed by passing through an expansion valve provided as the diaphragm mechanism 37 before it enters the water heat exchanger 33. In the water heat exchanger 33, the low temperature-low pressure liquid refrigerant is heated by high temperature engine cooling water, and is evaporated and vaporized so as to become the low temperature-low pressure gas refrigerant. Accordingly, even if there is a concern that the outdoor heat exchanger 32 used may be liable to frost formation, it is possible to evaporate and vaporize the liquid refrigerant using the water heat exchanger 33.

The refrigerant that has been changed into the low temperature-low pressure gas in this way is guided to the accumulator 34 and, after the liquid component has been separated out, is introduced into the compressor 31. The gas refrigerant introduced into the compressor 31 is compressed by the operation of the compressor 31, and changes into high temperature-high pressure gas and is sent to the indoor heat exchanger 11 again. As a result, a refrigeration cycle in which the state of the refrigerant is repeatedly changed is created.

When the evaporation performance of the water heat exchanger 33 is to be changed, in other words, when the number of outdoor heat exchangers 11 performing the heating operation is changed, this can be accomplished by adjusting the flow amount of the introduced engine cooling water.

Third Embodiment

Figure 12:
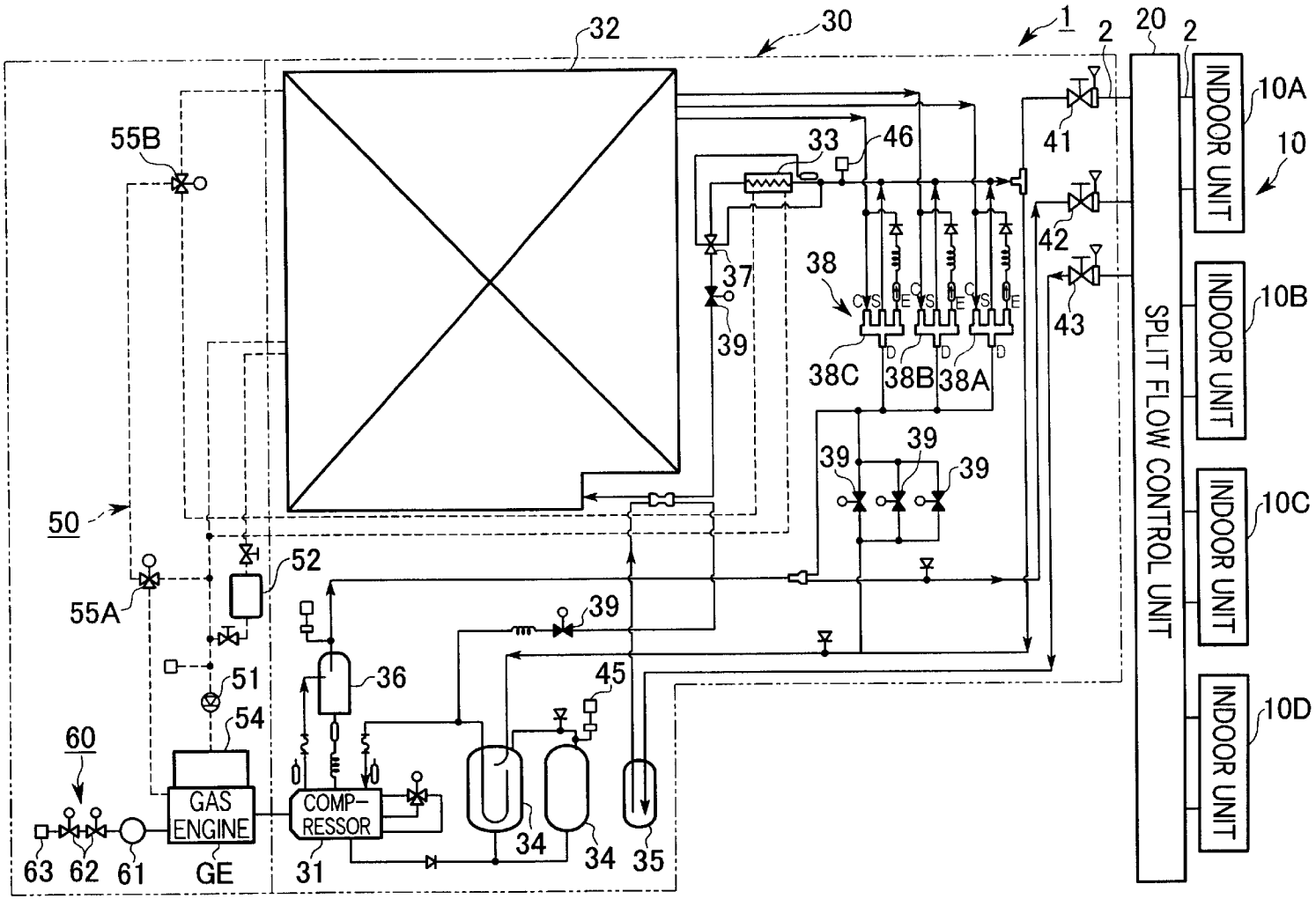
FIG. 12 is a view showing an embodiment of a multiform gas heat pump type of air conditioning system according to the present invention and shows a state in which all units are performing a cooling operation.
Figure 13:
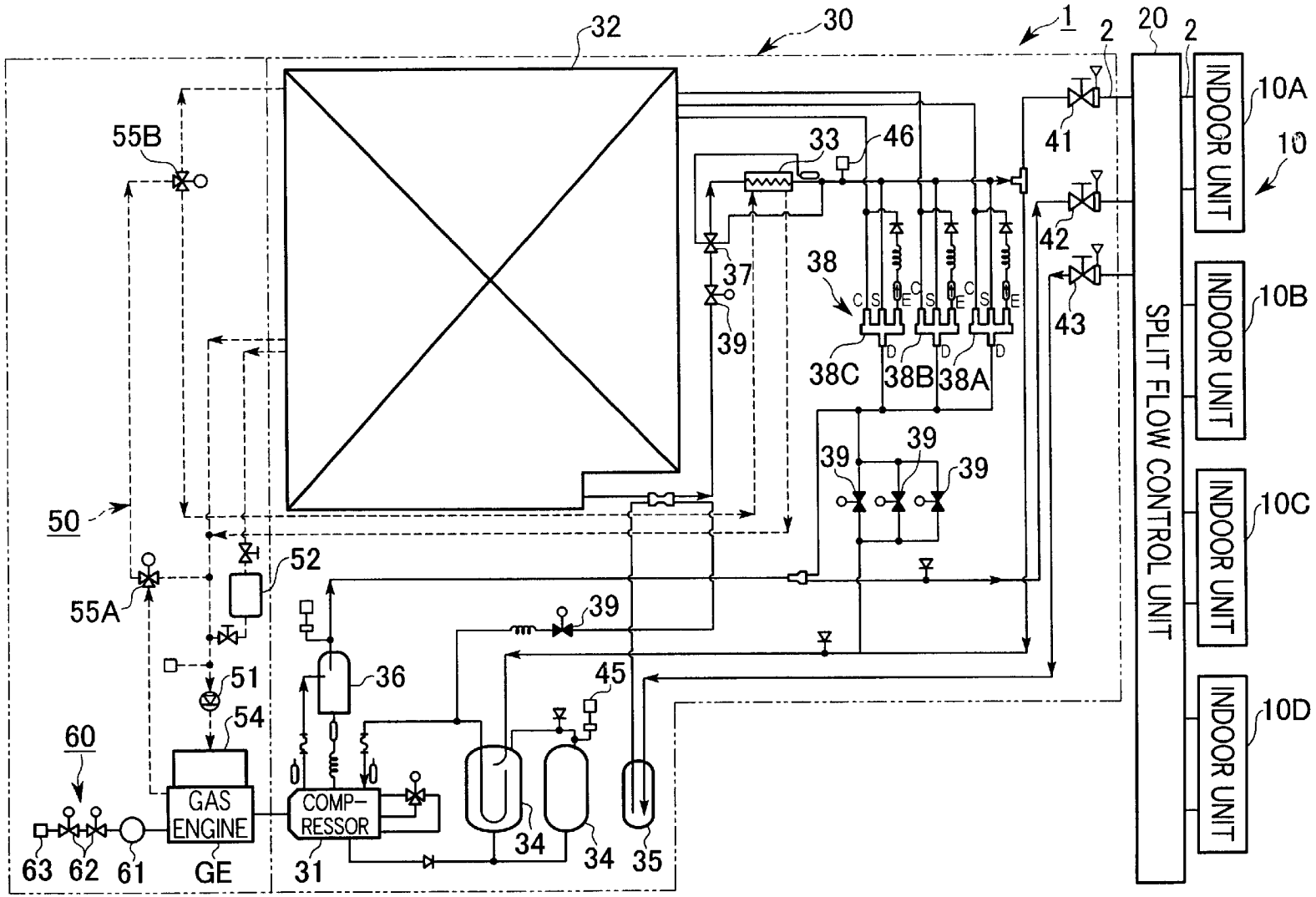
FIG. 13 is a view showing an embodiment of a multiform gas heat pump type of air conditioning system according to the present invention and shows a state in which all units are performing a heating operation when the outside temperature is low.

The third embodiment of the multiform gas heat pump type of air conditioning system of the present invention will now be described with reference made to FIGS. 12 and 13. The MGHP 1 shown in these drawings has a structure in which, in an MGHP 1 having the structure described in the first embodiment, a temperature sensor 46 is provided as a temperature detecting means for detecting the refrigerant outlet temperature of the water heat exchanger 33, and a pressure sensor 45 is provided in the accumulator 34 as a low pressure detecting means for detecting the intake side pressure (refrigerant saturation pressure) of the compressor 31.

In this embodiment, using the MGHP 1 having the structure described above, and a case is described in which all of the indoor units 10A to 10D perform a heating operation.

Firstly, a description will be given of when all of the indoor units 10A to 10D perform a normal heating operation using the outdoor heat exchanger.

In this case, the ports C and S communicate in each of the four-way valves 38A to 38C in the refrigerant circuit portion, and the discharge side of the compressor 31 and the indoor heat exchanger 11 are connected. In this state, high temperature-high pressure gas refrigerant discharged from the compressor 31 passes through the second operating valve 42 and is sent to the split flow control unit 20. The refrigerant that has been sent into the split flow control unit 20 passes through the electromagnetic valve 22 and is sent to the indoor heat exchangers 11 functioning as condensers of the respective indoor units 10A to 10D.

The high temperature-high pressure gas refrigerant performs a heat exchange with the indoor air in the indoor heat exchanger 11 and is condensed and liquefied. In this process, after the gas refrigerant has discharged heat and warmed the indoor air, it becomes high temperature-high pressure liquid refrigerant. This liquid refrigerant is decompressed by passing though the capillary tube 13 so as to become low temperature-low pressure liquid refrigerant, and is returned to the split flow control unit 20 via the check valve 14.

The low temperature-low pressure liquid refrigerant that has flowed into the split flow control unit 20 is sent through the electromagnetic valve 24 and the third operating valve 43 to the refrigerant circuit portion of the outdoor unit 30.

The liquid refrigerant sent to the refrigerant circuit portion 30 is separated into gas and liquid by passing through the receiver 35, and only the liquid refrigerant is sent to the outdoor heat exchanger 32 functioning as an evaporator. This liquid refrigerant is again decompressed by passing through a capillary tube provided as the diaphragm mechanism 37 before it enters the outdoor heat exchanger 32.

In the outdoor heat exchanger 32 the low temperature-low pressure liquid refrigerant captures heat from the outside air, and is evaporated and vaporized so as to become low temperature-low pressure gas refrigerant. At this time, if high temperature engine cooling water is supplied to the radiator 53, it is possible to evaporate and vaporize the liquid refrigerant efficiently using engine waste heat.

The refrigerant that has thus been changed into the low temperature-low pressure gas in this way is guided from the port C of the four-way valve 38 via the port S to the accumulator 34 and, after the liquid component has been separated out, is introduced into the compressor 31. The gas refrigerant introduced into the compressor 31 is compressed by the operation of the compressor 31, and changes into the high temperature-high pressure gas and is sent to the indoor heat exchanger 11 again. As a result, a refrigeration cycle in which the state of the refrigerant is repeatedly changed is created.

Next, a case will be described in which all of the indoor units 10A to 10D perform a heating operation during low outside temperatures with reference made to FIG. 13.

In this case as well, in the same manner as when all units are performing the normal heating operation as described above, the discharge side of the compressor 31 is connected to the indoor heat exchanger 11. In this state, high temperature-high pressure gas refrigerant that is discharged from the compressor 31 is sent via the second operating valve 42 to the split flow control unit 20. As is shown in FIG. 5, the refrigerant that has been sent into the split flow control unit 20 passes through the electromagnetic valve 22 and is sent to the indoor heat exchangers 11 functioning as condensers of the respective indoor units 10A to 10D.

The high temperature-high pressure gas refrigerant performs a heat exchange with the indoor air in the indoor heat exchanger 11 and is condensed and liquefied. In this process, after the gas refrigerant has discharged heat and warmed the indoor air it becomes high temperature-high pressure liquid refrigerant. This liquid refrigerant is decompressed by passing though the capillary tube 13 so as to become low temperature-low pressure liquid refrigerant, and is returned to the split flow control unit 20 via the check valve 14.

The low temperature-low pressure liquid refrigerant that has flowed into the split flow control unit 20 is sent through the electromagnetic valve 24 and the third operating valve 43 to the refrigerant circuit portion of the outdoor unit 30.

The liquid refrigerant sent to the refrigerant circuit portion 30 is separated into gas and liquid by passing through the receiver 35, and only the liquid refrigerant is sent to the water heat exchanger 33. At this time, the electromagnetic valve 39 provided on the intake side of the outdoor heat exchanger 32 is closed.

This liquid refrigerant is again decompressed by passing through an expansion valve provided as the diaphragm mechanism 37 before it enters the water heat exchanger 33. In the water heat exchanger 33 the low temperature-low pressure liquid refrigerant is heated by high temperature engine cooling water, and is evaporated and vaporized so as to become low temperature-low pressure gas refrigerant. Accordingly, even if the outside temperature is low and a sufficient evaporation performance cannot be obtained, or, even if the outdoor heat exchanger 32 is not used which causes a COP reduction because heat ends up conversely being discharged to the outside air, it is possible to evaporate and vaporize the liquid refrigerant using the water heat exchanger 33.

The refrigerant that has been changed into the low temperature-low pressure gas in this way is guided to the accumulator 34 and, after the liquid component has been separated out, it is introduced into the compressor 31. The gas refrigerant introduced into the compressor 31 is compressed by the operation of the compressor 31, and changes into the high temperature-high pressure gas and is sent to the indoor heat exchanger 11 again. As a result, a refrigeration cycle in which the state of the refrigerant is repeatedly changed is created.

When the heating operation using the above described water heat exchanger 33 is performed, in order to operate the compressor 31 efficiently, it is necessary to supply an appropriate degree of superheat to the compressed gas refrigerant that is taken in. This degree of superheat SH is calculated based on a formula SH=Th−Ts. Th in this formula is a refrigerant outlet temperature detected by the temperature sensor 46 provided at the outlet of the above described water heat exchanger 33. Ts is a refrigerant saturation temperature determined principally from the intake side pressure Pi detected by the pressured sensor 45 provided in the accumulator 43.

In this case, by detecting the refrigerant saturation pressure inside the accumulator 34 as the intake side pressure Pi, the refrigerant saturation temperature Ts corresponding to this refrigerant saturation pressure can be ascertained. In addition, the intake pressure Pi is a value that is set by the system diaphragm mechanism 37 and the like. In the description below the refrigerant saturation temperature Ts is taken as being 3.7° C.

Therefore, if, for example, the degree of superheat SH is set at 5° C., it is sufficient if the circulating amount of engine cooling water of the water heat exchanger 33 is adjusted such that, in accordance with Th=SH+Ts, the refrigerant outlet temperature Th becomes 7.8° C. Note that because there is a variable range, i.e. 5° C. to 10° C., for the appropriate degree of superheat SH, the actual target value for Th is not limited to the above calculated value and may be set, for example, to 9° C.

When a target value is set for the refrigerant outlet temperature Th of the water heat exchanger 33 in this manner, the two detected values Ts and Th are input into a control section (not shown) and, using a fuzzy calculation, for example, mainly the opening degree of the flow amount control valve 55B is adjusted and engine cooling water is also distributed to the water heat exchanger 33 and the radiator 53 such that the refrigerant outlet temperature Th reaches the target value. When the engine cooling water is being distributed, precedence is given to ensuring the flow amount needed to maintain the refrigerant outlet temperature Th of the water heat exchanger 33 at the target value, and the surplus portion of the water is sent to the radiator 53. Note that the flow amount adjusting valve 55A is used mainly in a heating operation of the gas engine GE with the aim of raising the temperature of the engine cooling water in a short length of time so that it does not flow into the radiator 53 and the water heat exchanger 33.

By employing this type of structure, it is possible to stably provide an appropriate degree of superheat to a gas refrigerant on the intake side of the compressor 31. As a result, the refrigerant is not supplied to the compressor 31 in the form of a two-phase gas and liquid, and it is possible to improve COP reduction as well as any deterioration in the heating performance caused by a reduction in the compression capability.

Fourth Embodiment

Figure 14:
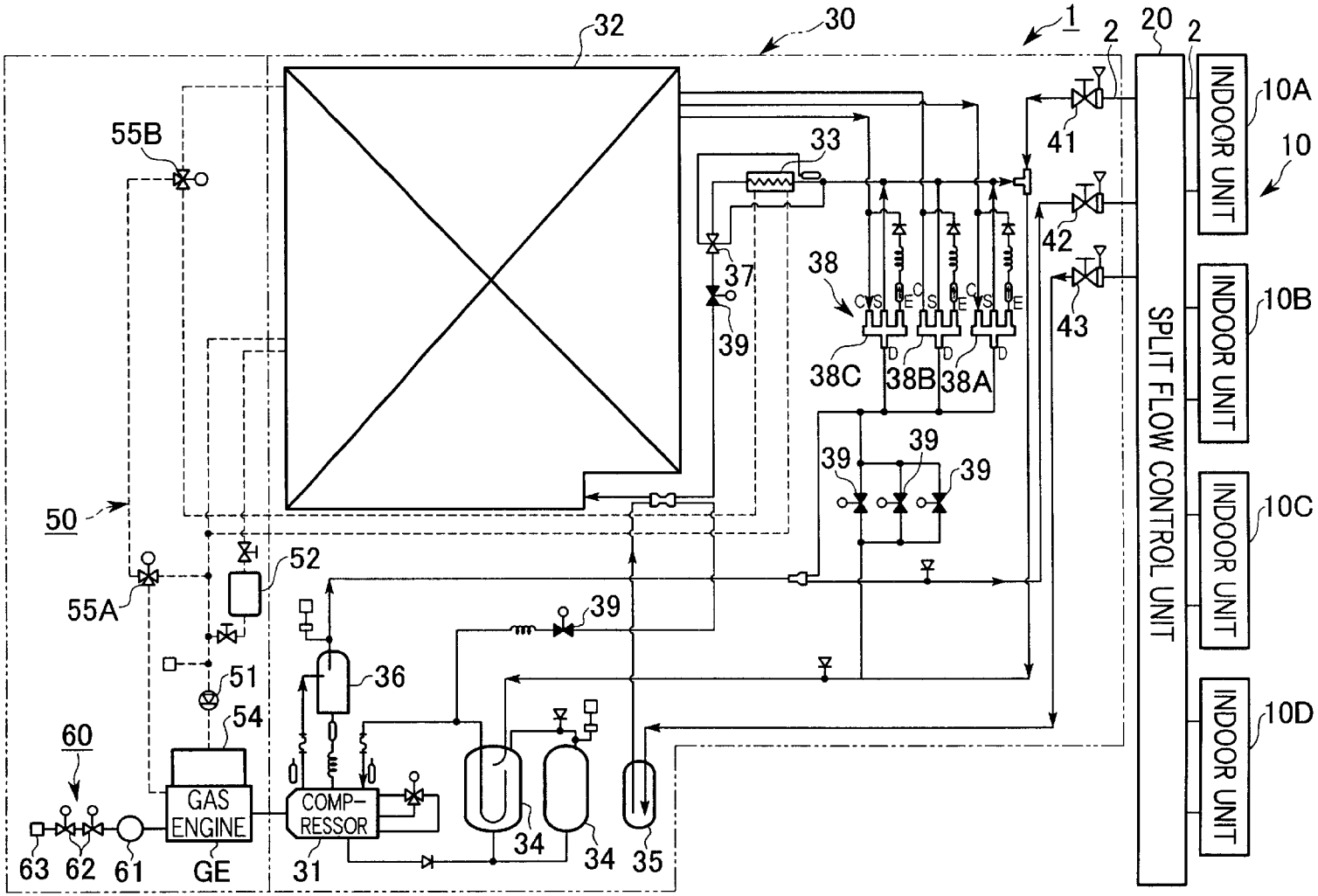
FIG. 14 is a view showing an embodiment of a multiform gas heat pump type of air conditioning system according to the present invention and shows a state in which both cooling and heating operations are being performed simultaneously.
Figure 15:
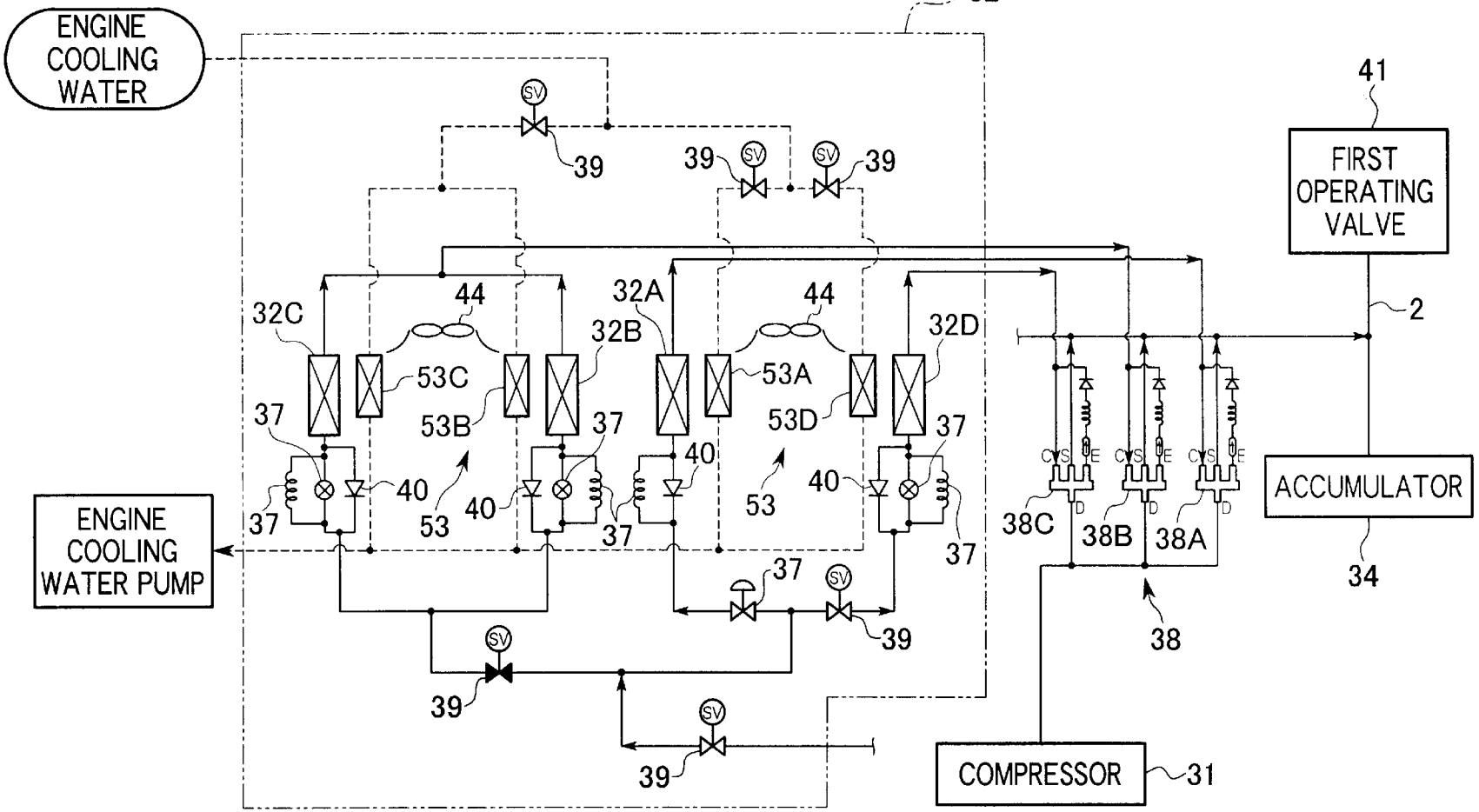
FIG. 15 is a view showing an example of a structure of the area around the outdoor heat exchanger shown in FIG. 13.
Figure 16:
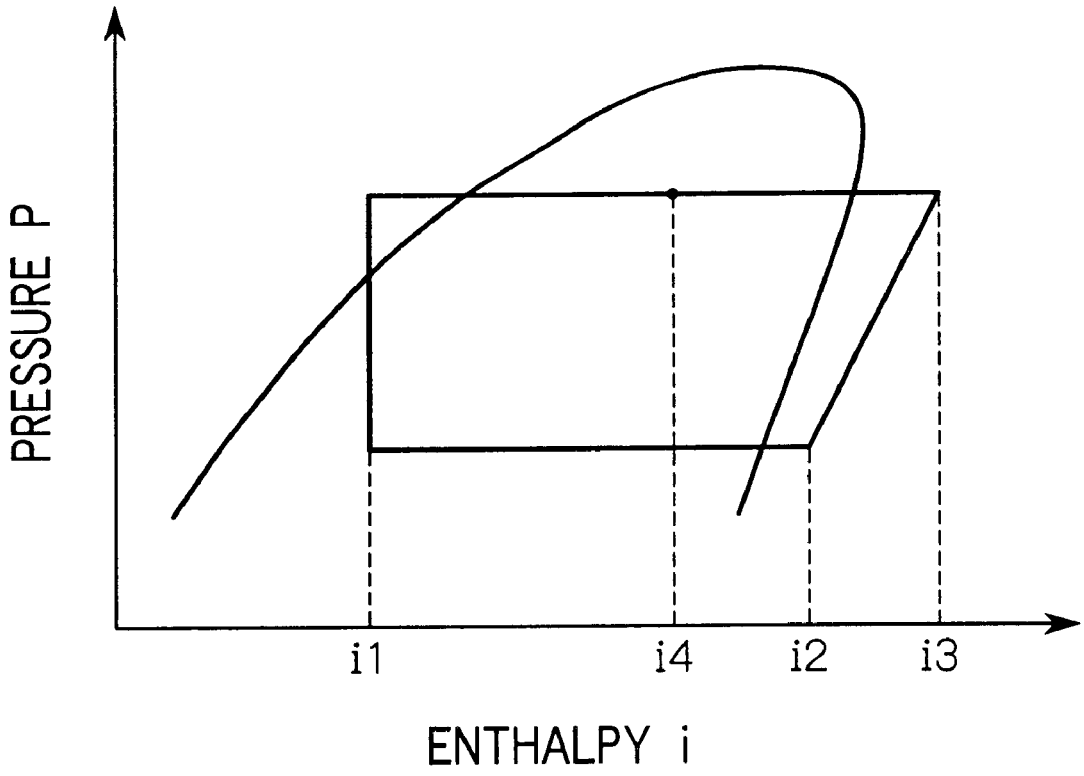
FIG. 16 is a Mollier diagram for explaining the problem points when both cooling and heating operations are performed simultaneously in a multiform gas heat pump type of air conditioning system.

The fourth embodiment of the multiform gas heat pump type of air conditioning system of the present invention will now be described with reference made to FIGS. 14 and 15.

In the fourth embodiment, using an MGHP 1 having the structure described in the first embodiment, and a case is described in which the indoor units 10A to 10D perform simultaneous heating and cooling operations. Note that, in the simultaneous heating and cooling operations described here, an example is given of when a cooling operation is included in what is mainly a heating operation. Specifically, an example is given of when a set of three indoor units 10A to 10C are performing a heating operation and the remaining set of one indoor unit 10D is performing a cooling operation.

In this case, the operations of the four-way valves 38A and 38C of the refrigerant circuit portion are switched so that all the ports C and S including those connected to the suspended operation portions described below communicate, while the discharge side of the compressor 31 is connected to the indoor heat exchanger 11 of the indoor units 10A to 10C.

In this state, high temperature-high pressure gas refrigerant discharged from the compressor 31 is sent to the split flow control unit 20 via the second operating valve 42. As is shown in FIG. 8 above, the refrigerant guided into the split flow control unit 20 is sent, via the respective electromagnetic valve 22 corresponding to each of the indoor units 10A to 10C, to the indoor heat exchangers 11A to 11C functioning as condensers in the respective indoor units 10A to 10C.

The high temperature-high pressure gas refrigerant then performs a heat exchange with the indoor air in the indoor heat exchangers 11A to 11C and becomes condensed and liquefied. In this process, the gas refrigerant discharges heat and warms the indoor air, thereafter becoming high temperature-high pressure liquid refrigerant. This liquid refrigerant is decompressed by passing through the capillary tube 13 and becomes low temperature-low pressure liquid refrigerant. The refrigerant is then returned to the split flow control unit 20 via the check valve 14.

The low temperature-low pressure liquid refrigerant that has flowed into the split flow control unit 20 is sent to the refrigerant circuit portion of the outdoor unit 30 via the electromagnetic valve 24 and the third operating valve 43.

On the other hand, in the cooling operation of the indoor unit 10D, the corresponding electromagnetic valves 21 and 24 in the split flow control unit 20 are set to open. Therefore, as is shown in FIG. 8 above, a part of the flow of the low temperature-low pressure liquid refrigerant sent from the indoor units 10A to 10C to the outdoor unit 30 is separated on the upstream side of the third operating valve 43, passes through the electromagnetic valve 24 and the electronic expansion valve 12, and is sent to the indoor heat exchanger 11D functioning as an evaporator.

The low temperature-low pressure liquid refrigerant sent to the indoor heat exchanger 11D is evaporated and vaporized by capturing heat from the indoor air and cools the indoor air. In this process, as it cools the indoor air it changes to low temperature-low pressure gas refrigerant and is returned to the split flow control unit 20. The low temperature-low pressure gas refrigerant inside the split flow control unit 20 passes through the electromagnetic valve 21 and is sent from the first operating valve 41 to the refrigerant circuit portion of the outdoor unit 30.

The remainder of the liquid refrigerant that has been flowed to the indoor unit 10D is sent from the third operating valve 43 to the refrigerant circuit portion 30. This liquid refrigerant is separated into gas and liquid by passing through the receiver 35 and the liquid refrigerant alone is sent to the outdoor heat exchanger 32 functioning as the evaporator. This liquid refrigerant is decompressed again by passing through the capillary tube provided as the diaphragm mechanism 37 before entering the outdoor heat exchanger 32.

It should be noted that the evaporation performance required in the outdoor heat exchanger 32 does not have to be as high as when all units are performing a heating operation. Namely, out of the four sets of indoor units 10A to 10D that are provided, because three sets are performing the heating operation and the remaining one set is performing the cooling operation, a total evaporation performance obtained from using approximately 50% of the outdoor heat exchange units 32A to 32D that have been divided into four as well as the indoor heat exchanger 11D that is performing the cooling operation is sufficient. Therefore, in this example, the outdoor heat exchangers 32A and 32D are used and the operations of the remaining 50% of the outdoor heat exchangers, 32B and 32C, are suspended.

Accordingly, the low temperature-low pressure liquid refrigerant captures heat from the outside air during the process of flowing through the outdoor heat exchangers 32A and 32D, and is evaporated and vaporized to become low temperature-low pressure gas refrigerant. At this time, if high temperature engine cooling water is supplied to the radiator 53, it is possible to efficiently evaporate and vaporize the liquid refrigerant using engine waste heat.

The refrigerant that has changed into the low temperature-low pressure gas in this manner is guided from the ports C of the four-way valves 38A and 38C through the port S to the accumulator 34. The low temperature-low pressure gas refrigerant that has been evaporated and vaporized in the indoor heat exchanger 11D merges with the gas refrigerant guided to the accumulator 34 from the four-way valves 38A and 38C at the downstream side of the first operating valve 41 and is guided in the same way to the accumulator 34. After the liquid component has been separated out from of the low temperature-low pressure gas refrigerant guided to the accumulator 34, the low temperature-low pressure gas refrigerant is introduced into the compressor 31. The gas refrigerant introduced into the compressor 31 is compressed by the operation of the compressor 31 so as to change into the high temperature-high pressure gas refrigerant, and is then sent to the internal heat exchanger 11 again. As a result, a refrigeration cycle in which the state of the refrigerant is repeatedly changed is created.

In this type of simultaneous cooling and heating operations, the operations of the outdoor heat exchangers 32C and 32D are suspended as described above. However, because the operation of the four-way valve 38B that is connected to the outdoor heat exchangers 32B and 32C is also switched simultaneously with the other four-way valves 38A and 38C such that the ports C and S communicate, the portion of the divided outdoor heat exchangers that is in a suspended operation state is also automatically connected to the intake side of the compressor 31 via the accumulator 34.

Therefore, in the outdoor heat exchangers 32B and 32C that are in a state of suspended operation, the internal pressure is affected by the suction of the compressor 31 and is reduced. As a result of this pressure reduction, because the saturation temperature of the liquid refrigerant accumulated inside the outdoor heat exchangers 32B and 32C is also reduced, the liquid refrigerant is evaporated and vaporized and changes into the low temperature-low pressure gas refrigerant, and is suctioned from the four-way valve 38B into the compressor 31. Namely, in the same way as the gas refrigerant evaporated and vaporized in the outdoor heat exchangers 32A and 32D that are functioning as evaporators, the gas refrigerant that is evaporated and vaporized due to the reduction in the saturation temperature is also suctioned into the compressor 31 through the four-way valve 38B. Therefore, the refrigerant that accumulates in the suspension of operation of the outdoor heat exchanger 32 is recovered in the refrigeration cycle, and it is possible to prevent the insufficiency of refrigerant.

The suspended outdoor heat exchanger 32 is not limited to that described above and various appropriate selections are possible in accordance with the state of the simultaneous heating and cooling operations of the indoor unit 10 such as, for example, suspending the operation of the outdoor heat exchanger 32A independently, simultaneously suspending the operations of the outdoor heat exchangers 32B and 32C, and simultaneously suspending the operations of the outdoor heat exchangers 32A to 32D. In these cases as well, the C and S ports of a four-way valve 38 connected to an outdoor heat exchanger in a suspended operation state are placed in a communicating state and communicating them with the intake system of the compressor 31, it is possible to automatically recover refrigerant from the outdoor heat exchanger in a suspended operation state in the same way as is described above.

It is to be understood that the structure of the present invention is not limited to that in each of the above described embodiments and various appropriate alterations are possible insofar as they do not deviate from the purpose of the present invention.

What is claimed is:

1. The A multiform gas heat pump type of air conditioning system, comprising:

a plurality of indoor units that are each provided with an indoor heat exchanger and that are configured to perform a heat exchange between air inside a room and refrigerant;

an outdoor unit provided with a compressor driven by a gas engine and an outdoor heat exchanger configured to perform a heat exchange between outside air and the refrigerant; and a split flow control unit configured to control a flow direction of the refrigerant in each of said indoor units and to perform a selection switching between cooling and heating operations, wherein said outdoor heat exchanger is divided into a plurality of units that are connected in parallel, and there is provided a refrigerant supply switching means for controlling the refrigerant flow in each division portion of said outdoor heat exchanger, and a radiator of said gas engine is provided adjacent to said outdoor heat exchanger, and the radiator is divided into a plurality of units that are connected in parallel, and there is provided a switching means for controlling engine cooling water flow in each unit of the radiator.

2. The multiform gas heat pump type of air conditioning system according to claim 1, wherein control of an amount of outside air that is introduced is performed using an outdoor unit fan in said outdoor heat exchanger.

3. A multiform gas heat pump type of air conditioning system, comprising:

a plurality of indoor units that are each provided with an indoor heat exchanger and that are configured to perform a heat exchange between air inside a room and refrigerant;

an outdoor unit provided with a compressor driven by a gas engine and an outdoor heat exchanger configured to perform a heat exchange between outside air and the refrigerant; and a split flow control unit configured to control a flow direction of the refrigerant in each of the indoor units and to perform a selection switching between cooling and heating operations, wherein in the outdoor unit, a water heat exchanger is provided parallel with the outdoor heat exchanger that is configured to heat the refrigerant by obtaining waste heat from engine cooling water used for cooling the gas engine, and is configured to perform a warming operation when an outside temperature is low and fulfills the conditions for frost formation by evaporating and vaporizing the refrigerant by the water heat exchanger.

4. A multiform gas heat pump type of air conditioning system, comprising:

a plurality of indoor units that are each provided with an indoor heat exchanger and that are configured to perform a heat exchange between air inside a room and refrigerant;

an outdoor unit provided with a compressor driven by a gas engine and an outdoor heat exchanger configured to perform a heat exchange between outside air and a refrigerant; and a split flow control unit configured to control a flow direction of the refrigerant in each of the indoor units and to perform a selection switching between cooling and heating operations, wherein the outdoor heat exchanger is divided into a plurality of units that are connected in parallel, and there is provided a refrigerant supply switching means that for controlling the refrigerant flow in each division portion of the outdoor heat exchanger, and in the outdoor unit, a water heat exchanger is provided parallel with the outdoor heat exchanger that is configured to heat the refrigerant by obtaining waste heat from engine cooling water used for cooling the gas engine, and a circulation amount of engine cooling water introduced into the water heat exchanger is controlled so that the degree of superheat of the refrigerant on an intake side of the compressor is kept within a predetermined range.

5. The A multiform gas heat pump type of air conditioning system, comprising:

a plurality of indoor units that are each provided with an indoor heat exchanger and that are configured to perform a heat exchange between air inside a room and refrigerant;

an outdoor unit provided with a compressor driven by a gas engine and an outdoor heat exchanger configured to perform a heat exchange between outside air and the refrigerant; and a split flow control unit configured to control a flow direction of the refrigerant in each of said indoor units and to perform a selection switching between cooling and heating operations, wherein said outdoor heat exchanger is divided into a plurality of units that are connected in parallel, and there is provided a refrigerant supply switching means for controlling the refrigerant flow in each division portion of said outdoor heat exchanger, and a degree of superheat for the refrigerant is calculated from a value detected by a low pressure detecting means for detecting pressure on an intake side of the compressor and a value detected by a temperature detecting means for detecting a refrigerant outlet temperature of the water heat exchanger.

6. A multiform gas heat pump type of air conditioning system, comprising:

a plurality of indoor units that are each provided with an indoor heat exchanger and that are configured to perform a heat exchange between air inside a room and refrigerant;

an outdoor unit provided with a compressor driven by a gas engine and an outdoor heat exchanger configured to perform a heat exchange between outside air and the refrigerant; and a split flow control unit configured to control a flow direction of the refrigerant in each of the indoor units and to perform a selection switching between cooling and heating operations, wherein the outdoor heat exchanger is divided into a plurality of units that are connected in parallel, and there is provided a refrigerant supply switching means for controlling the refrigerant flow in each division portion of the outdoor heat exchanger, and a division portion of the outdoor heat exchanger that is in a state of suspended operation is configured to communicate with an intake system of the compressor by an operation of said refrigerant supply switching means.

* * * * *